US009428357B2

(12) United States Patent
Terashima

(10) Patent No.: US 9,428,357 B2
(45) Date of Patent: Aug. 30, 2016

(54) CONVEYING DEVICE AND CONVEYING CONTROL METHOD

(75) Inventor: Hideyuki Terashima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 854 days.

(21) Appl. No.: 13/571,804

(22) Filed: Aug. 10, 2012

(65) Prior Publication Data

US 2013/0044154 A1 Feb. 21, 2013

(30) Foreign Application Priority Data

Aug. 19, 2011 (JP) ..... 2011-179779

(51) Int. Cl.
*B65H 9/00* (2006.01)
*B65H 7/06* (2006.01)

(52) U.S. Cl.
CPC ..... *B65H 9/008* (2013.01); *B65H 7/06* (2013.01); *B65H 2511/212* (2013.01); *B65H 2511/216* (2013.01); *B65H 2513/53* (2013.01); *B65H 2701/1311* (2013.01)

(58) Field of Classification Search
CPC ..... B65H 9/008
See application file for complete search history.

(56) References Cited

U.S. PATENT DOCUMENTS

| | | | | |
|---|---|---|---|---|
| 5,226,741 | A | 7/1993 | Kumazaki et al. | |
| 7,077,517 | B2 | 7/2006 | Awai et al. | |
| 8,079,589 | B2 | 12/2011 | Kinoshita et al. | |
| 2003/0085513 | A1 * | 5/2003 | Takahara et al. ..... | 271/270 |

FOREIGN PATENT DOCUMENTS

| | | | |
|---|---|---|---|
| JP | 05-201082 | A | 8/1993 |
| JP | 11-115270 | A | 4/1999 |
| JP | 2005-007817 | | 1/2005 |
| JP | 2010-046994 | | 3/2010 |

* cited by examiner

*Primary Examiner* — Manish S Shah
*Assistant Examiner* — Jeffrey C Morgan
(74) *Attorney, Agent, or Firm* — Fitzpatrick, Cella, Harper & Scinto

(57) ABSTRACT

A conveying device and a conveying control method that can control a phase of a main conveying roller and a position of a print medium with an inexpensive configuration and a fast throughput are provided. For that purpose, an LF roller phase is obtained, phase matching control is performed so that the print medium comes to a desired position when the LF roller is at a desired phase, and skewing of the print medium is corrected by the same control method as the phase matching control.

7 Claims, 25 Drawing Sheets

CONVEYING DEVICE AND CONVEYING CONTROL METHOD

BACKGROUND OF THE INVENTION

1. Field of the Invention

The present invention relates to a conveying device and a conveying control method and particularly to a conveying device and a conveying control method in which a phase of a conveying roller and a position of a print medium are controlled.

2. Description of the Related Art

Conventionally, in an inkjet printer, a high-accuracy roller in which a metal shaft is coated with a grinding stone has been used as a main conveying roller. As a sub conveying roller also functioning as a discharge roller located on the downstream of the main conveying roller, a rubber roller having an accuracy lower than the main conveying roller and formed by rubber being attached to a metal shaft has been used.

According to this configuration, a conveying error is large in delivery of a print medium from the main conveying roller to the sub conveying roller and in conveyance only with the sub conveying roller, and it has been difficult to realize higher image quality and higher throughput.

As a measure against that, printing of a test pattern on a print medium and reading and analysis of the printed data by a scanner have been performed in recent years. A technology is proposed that characteristics (outer diameter, deflection, and the like) of the main and sub conveying rollers are obtained by performing the above-described analysis using a test pattern, and the obtained result is fed back as a correction value in printing and conveyance is performed (Japanese Patent Laid-Open No. 2005-007817). When this type of method is used, a technology of controlling a phase of the main conveying roller or the sub conveying roller and a position of the print medium becomes important for the following two reasons.

When the test pattern is printed, the sub conveying roller cannot print one cycle since a length of a single print medium is not sufficient. Thus, it is necessary to separate a print for one cycle into two sheets for printing. Thus, the first reason is that if the print for one cycle is separated into two sheets for printing, the phase of the sub conveying roller and the position of the print medium should be controlled so that there is no conveying error.

Moreover, a second reason is that the phases of the main conveying roller and the sub conveying roller should be fixed to optimal phases when the print medium is delivered from the main conveying roller to the sub conveying roller so that the conveying error is stabilized and can be easily corrected. This technology is proposed in Japanese Patent Laid-Open No. 2010-046994, for example.

According to the configuration described in Japanese Patent Laid-Open No. 2010-046994, the conveying roller and a feeding roller need to be driven and controlled, respectively in order to match the phase of the conveying roller with the position of the print medium. This can be realized by driving the conveying roller and the feeding roller by separate motors and by controlling the rollers individually, for example. Alternatively, this can be realized by coupling the conveying roller and the feeding roller with a motor through drive switching device, respectively, by switching driving of the motor by the drive switching device and by controlling rotation of the conveying roller or the feeding roller.

However, such realizing device has many demerits such as cost increase caused by provision of a plurality of motors, reduction in a throughput due to operation of the drive switching device, complication of drive transmitting device and control and the like.

SUMMARY OF THE INVENTION

Thus, in order to solve the above-described problems, the present invention has an object to provide a conveying device and a conveying control method that can control a phase of a main conveying roller and a position of a print medium with an inexpensive configuration and a fast throughput.

A conveying device of the invention of this application is a conveying device including first conveying device for conveying a print medium, second conveying device provided on the downstream side of the first conveying device in a conveying direction of the print medium and for conveying the print medium by means of rotation, detecting device provided between the first conveying device and the second conveying device in a conveying path of the print medium and for detecting a position of the print medium conveyed by the first conveying device, correcting device for correcting skewing of the print medium by bending the print medium between the first conveying device and the second conveying device in the conveying path of the print medium, and phase detecting device for detecting a phase of rotation of the second conveying device, in which on the basis of a result of detection by the phase detecting device, phase matching control is made so that the print medium comes to a desired position when the second conveying device is at a desired phase, and skewing of the print medium is corrected by the correcting device by the same control as the phase matching control.

Moreover, a conveying control method of the invention of this application is a conveying control method including a first conveying step for conveying a print medium, a second conveying step for conveying the print medium by means of rotation after the first conveying step in a conveying direction of the print medium, a detection step for detecting a position of the print medium conveyed in the first conveying step between the first conveying step and the second conveying step in a conveying path of the print medium, a correction step for correcting skewing of the print medium by bending the print medium between the first conveying step and the second conveying step in the conveying path of the print medium, and a phase detection step for detecting a phase in rotation in the second conveying step, in which on the basis of a result of detection in the phase detection step, a phase matching control step in which the print medium comes to a desired position when a phase of the rotation in the second conveying step is a desired phase and a step for correcting skewing of the print medium in the correction step by the same control as control in the phase matching control step are provided.

According to the present invention, the conveying device performs the phase matching control in which the print medium comes to a desired position when the second conveying device has a desired phase on the basis of the result of the detection by the phase detecting device and corrects skewing of the print medium by the correcting device by the same control as the phase matching control.

As a result, a conveying device and a conveying control method that can control the phase of the main conveying roller and the position of the print medium with an inexpensive configuration and a fast throughput can be realized.

Further features of the present invention will become apparent from the following description of exemplary embodiments (with reference to the attached drawings).

DESCRIPTION OF THE EMBODIMENTS

Figure 1:
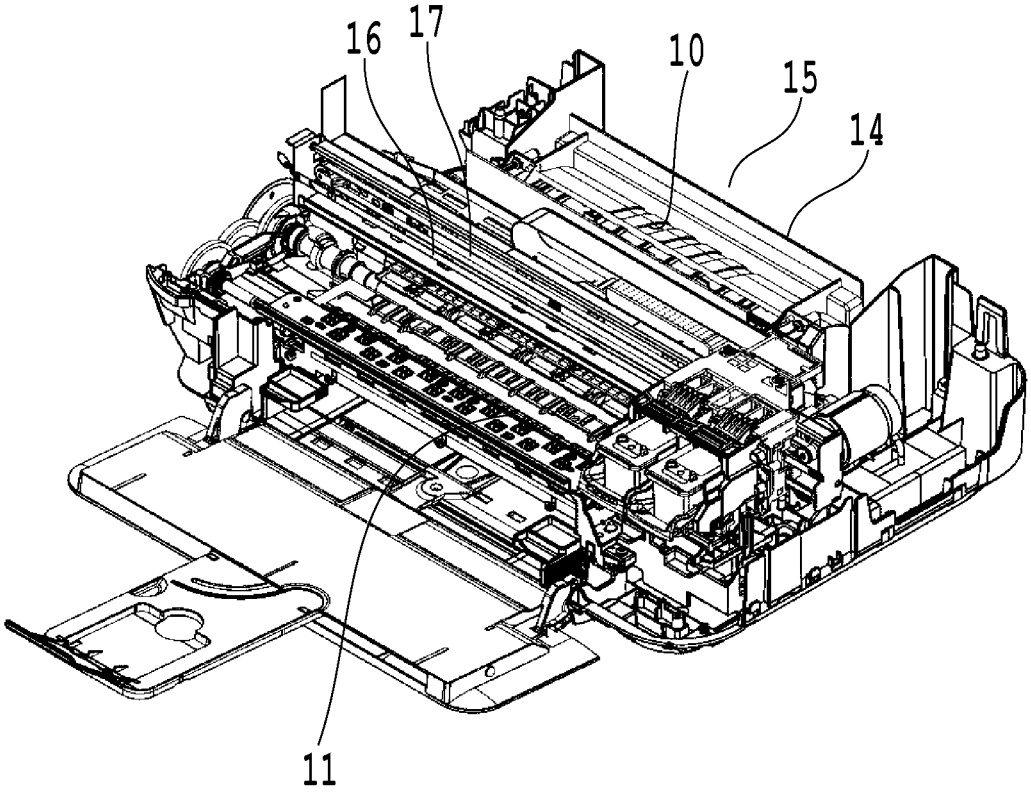
FIG. 1 is a perspective view of an embodiment of a sheet-feeding and conveying device of a printing apparatus in the present invention.
Figure 2:
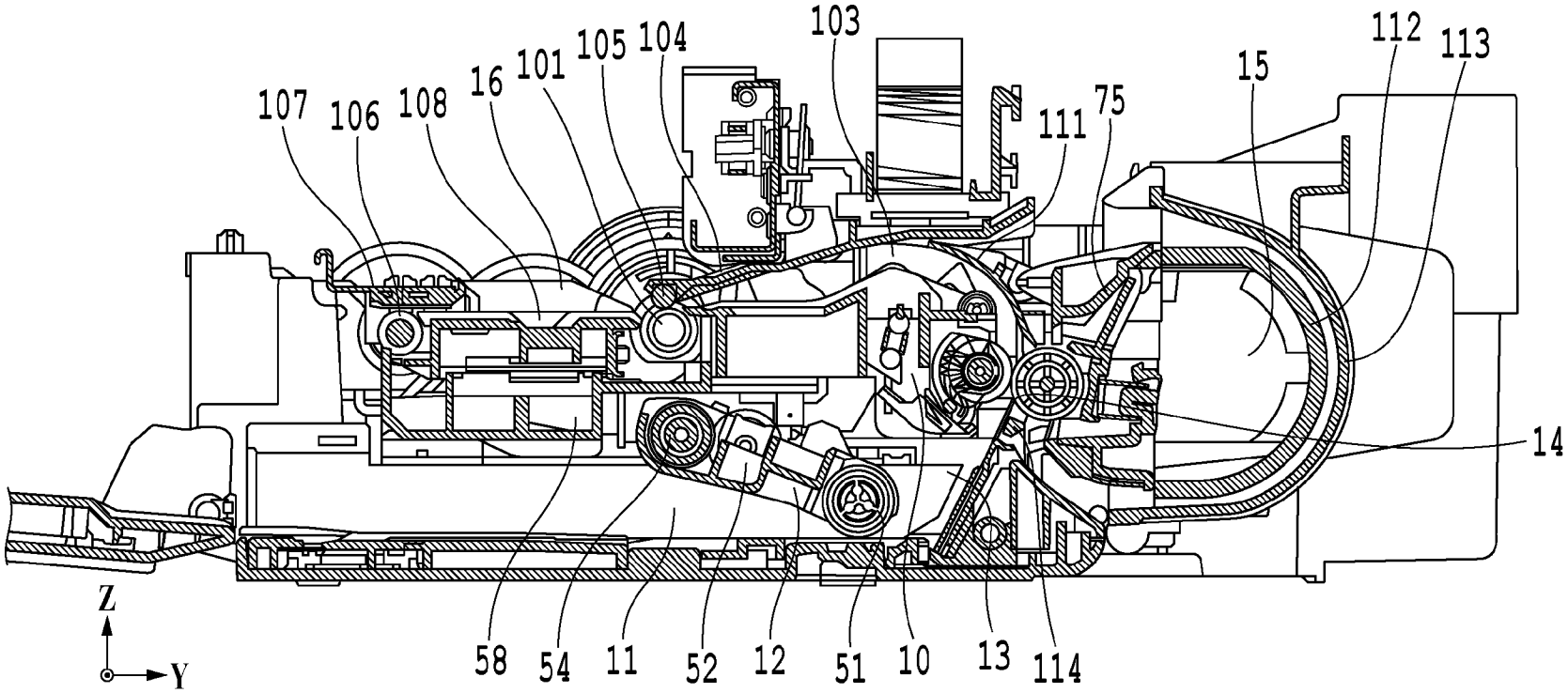
FIG. 2 is a longitudinal sectional view of the sheet-feeding and conveying device in FIG. 1.

An embodiment of the present invention will be specifically described below by referring to drawings. The same reference numerals refer to the same or corresponding portions throughout the each drawing. FIG. 1 is a perspective view of one embodiment of a sheet-feeding and conveying device of a printing apparatus in the present invention. FIG. 2 is a longitudinal sectional view of the sheet-feeding and conveying device in FIG. 1. In FIGS. 1 and 2, a sheet-feeding and conveying device 10 is mainly composed of a print-medium loading portion 11, a sheet feeding portion 12, a separation portion 13, a reversing conveying portion 14, a double-sided conveying path 15, and a horizontal conveying portion 16.

(Explanation of Flow of Print Medium in Each Unit)

A bundle of print mediums set on the print-medium loading portion 11 is separated into a single print medium by the sheet feeding portion 12 and the separation portion 13 and fed to the reversing conveying portion 14. Then, the front and back of the print medium are reversed in the reversing conveying portion 14, fed to the horizontal conveying portion 16, goes through an image forming portion 17 and is discharged. The image forming portion (hereinafter also referred to as an image processing portion) 17 is composed of a printable unit such as inkjet printing device.

(Explanation of Configuration of Loading Portion)

Figure 3:
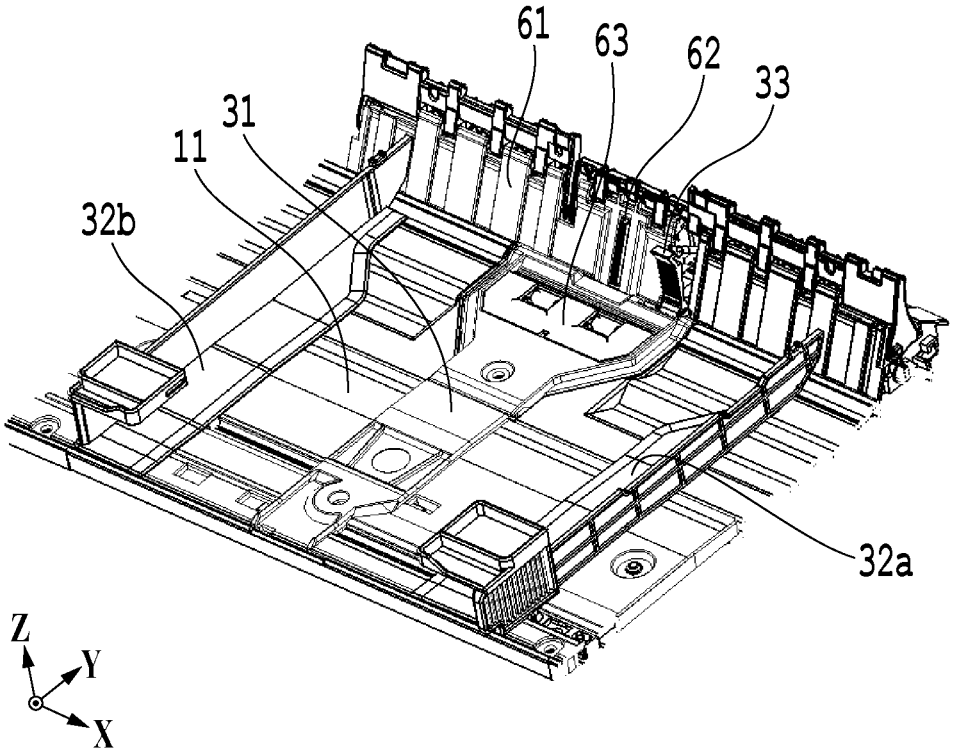
FIG. 3 is a perspective view of a loading portion in a state where a print medium has not been set yet when seen diagonally.
Figure 4:
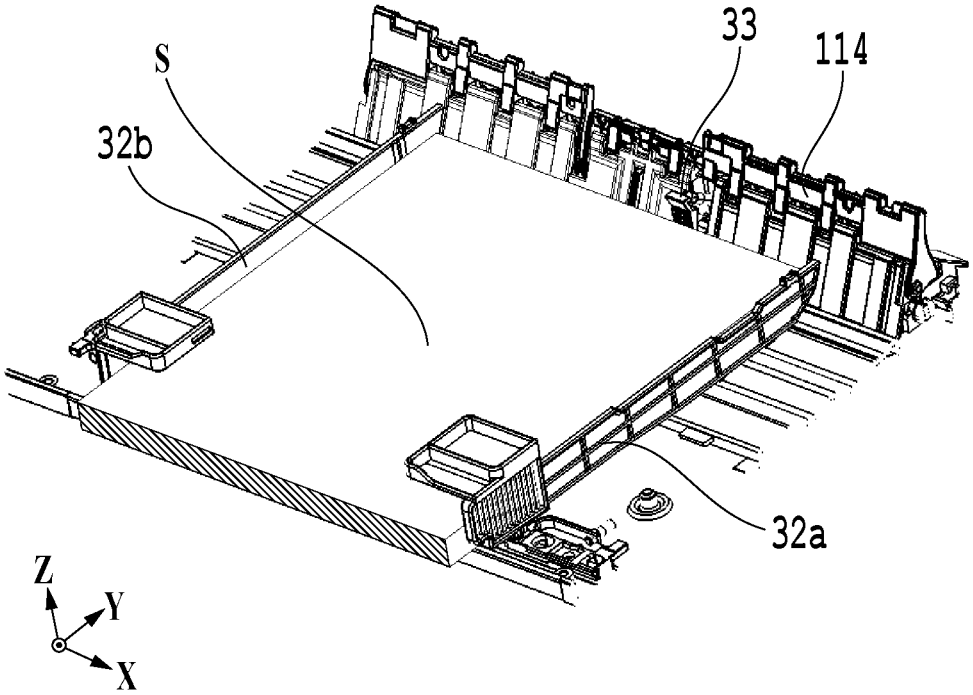
FIG. 4 is a perspective view of the loading portion in a state where the print medium is set when seen from diagonally above.

Subsequently, a configuration of the loading portion 11 will be described. FIG. 3 is a perspective view of the loading portion 11 in a state where a print medium has not been set yet when seen diagonally. Moreover, FIG. 4 is a perspective view of the loading portion 11 in a state where the print medium is set when seen from diagonally above. The print-medium loading portion 11 includes a loading surface 31 for holding a plurality of print mediums S substantially horizontally, side guides 32*a* and 32*b* for guiding both side faces of the print medium S, and a tip-end reference surface 33 for guiding the tip end of the print medium S.

The tip-end reference surface 33 is attached capable of swing, configured substantially perpendicularly to a sheet feeding direction except during a sheet-feeding operation and serves as an abutment reference when a user sets a print medium. On the other hand, the tip-end reference surface 33 is configured to retreat to the outside of a conveying path (conveying route) of the print medium S during sheet feeding.

(Explanation of Configuration of Sheet Feeding Portion)

Figure 5:
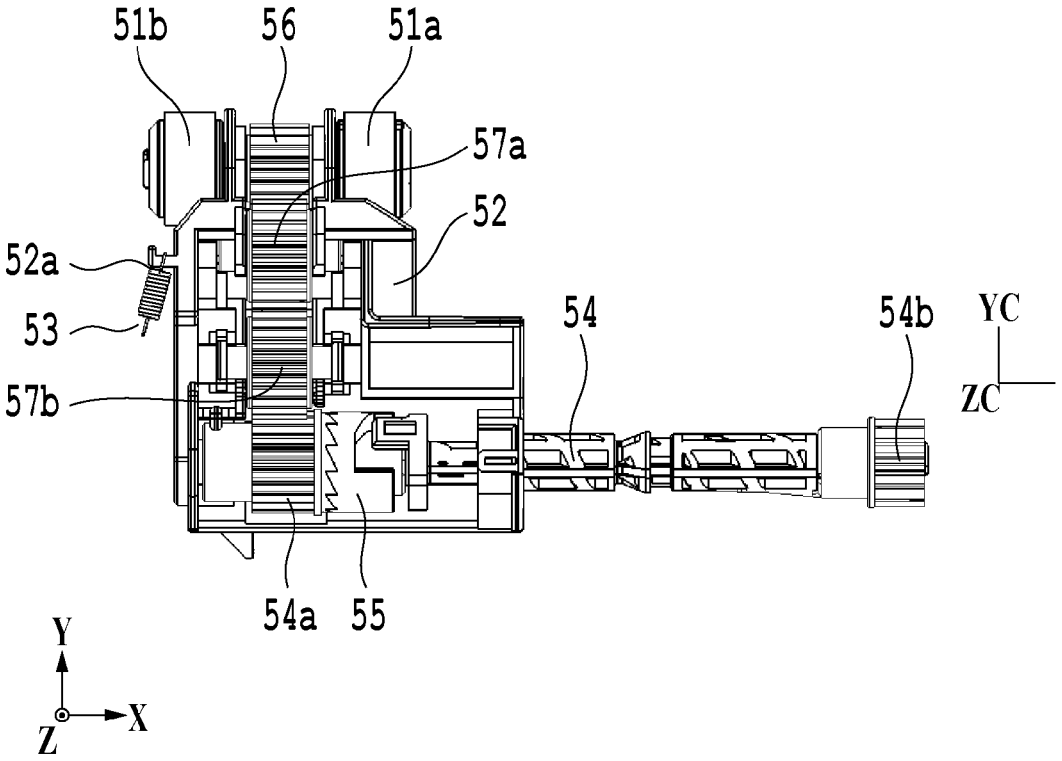
FIG. 5 is a back face view of sheet feeding device constituting a sheet feeding portion when seen from below.

Subsequently, a configuration of the sheet feeding portion 12 will be described. FIG. 5 is a back face view of sheet feeding device constituting the sheet feeding portion 12 when seen from below. A swing arm 52 pivotally supports sheet feeding rollers 51*a* and 51*b* capable of swing. A biasing spring 53 is spring device stretched between a hook portion 52*a* of the swing arm 52 and a hook portion, not shown, of a sheet feeding base 58 (See FIG. 2). A drive shaft 54 transmits driving to the sheet feeding rollers 51*a* and 51*b*.

A one-way clutch 55 which transmits a torque only in one direction is attached between an input gear 54*b* for transmitting driving from a driving source, not shown, to the drive shaft 54 and an output gear 54*a*. The one-way clutch 55 is configured such that the torque is transmitted when a torque from the input gear 54*b* to the output gear 54*a* rotates the sheet feeding rollers 51*a* and 51*b* in a sheet feeding direction.

On the swing arm 52, idler gears 57*a* and 57*b* for transmitting the driving from an output gear portion 54*a* of the drive shaft 54 to a sheet-feeding roller gear 56 is pivotally supported. The swing arm 52 is attached to the lower surface side of the sheet feeding base 58 capable of rotary motion (swing). Moreover, the drive shaft 54 is also rotatably fitted and pivotally supported on the sheet feeding base 58 coaxially with a rotating fulcrum of the swing arm 52.

(Explanation of Configuration of Separation Portion)

Figure 6:
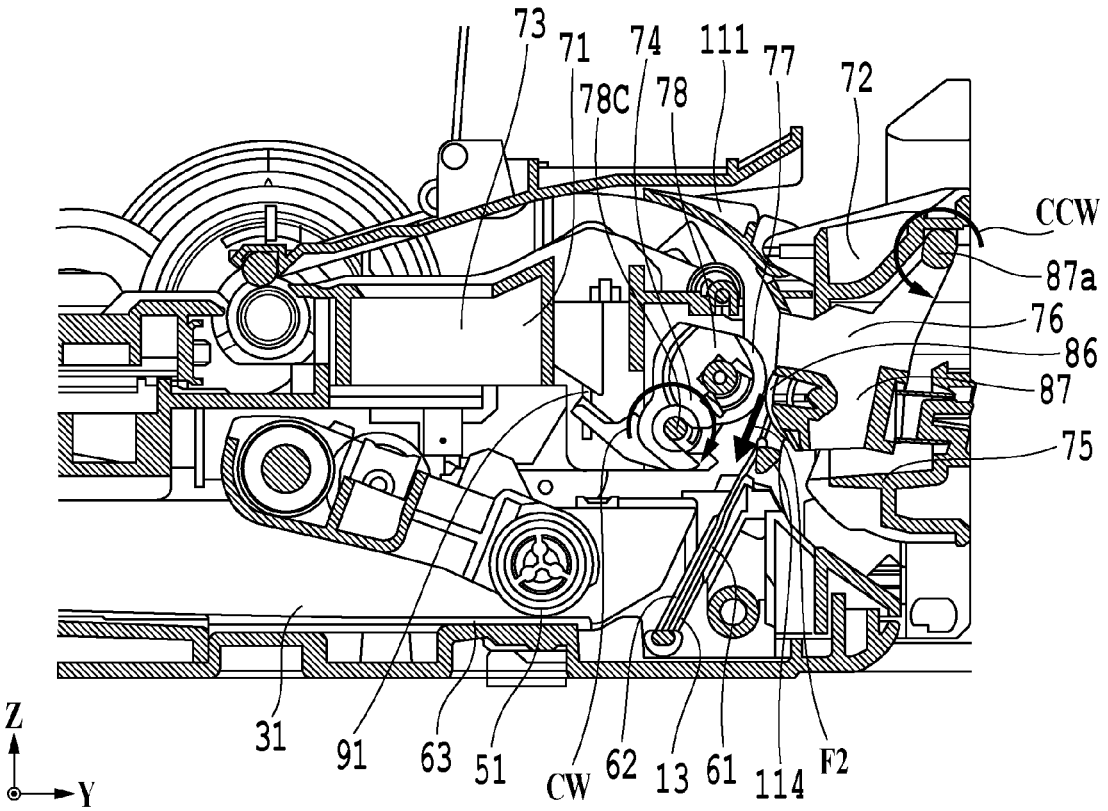
FIG. 6 is a longitudinal sectional view of the sheet feeding portion, a separation portion, a reversing conveying portion, and a horizontal conveying portion.

FIG. 6 is a longitudinal sectional view of the sheet feeding portion 12, the separation portion 13, the reversing conveying portion 14, and the horizontal conveying portion 16. By using FIGS. 3 and 6, a configuration of the separation portion 13 will be described. A separation method of the separation portion 13 in the embodiment is a cost-advantageous separation bank method. The separation portion 13 is composed of a separation bank surface 61 having a surface inclined to the sheet feeding direction and functioning as a separation bank, a separation assisting member 62 provided at the center of the separation bank surface 61, and a separation print medium 63 attached to the loading surface 31 of the print medium S.

The separation assisting member 62 is attached slightly protruding from the inclined surface of the separation bank surface 61 and is configured such that, when the print medium S is fed, first, the separation assisting member 62 is first brought into contact with the print medium tip end and gives resistance. Moreover, the separation assisting member 62 is attached movably in the horizontal direction and is configured to retreat when being pressed with a load stronger than predetermined.

In the configuration, when the sheet feeding roller 51 is rotated and driven, the loaded print medium S is fed out while being pressed by the sheet feeding roller 51. When the tip end of the print medium S is pressed onto the separation assisting member 62 and the separation bank surface 61 and receives resistance, elasticity of the print medium S and a friction force received at the print medium tip end separate the uppermost print medium S from the print mediums below (the subsequent print medium and after) and feeds only one sheet to the conveying path.

(Explanation of Configuration of Reversing Conveying Portion)

Figure 7:
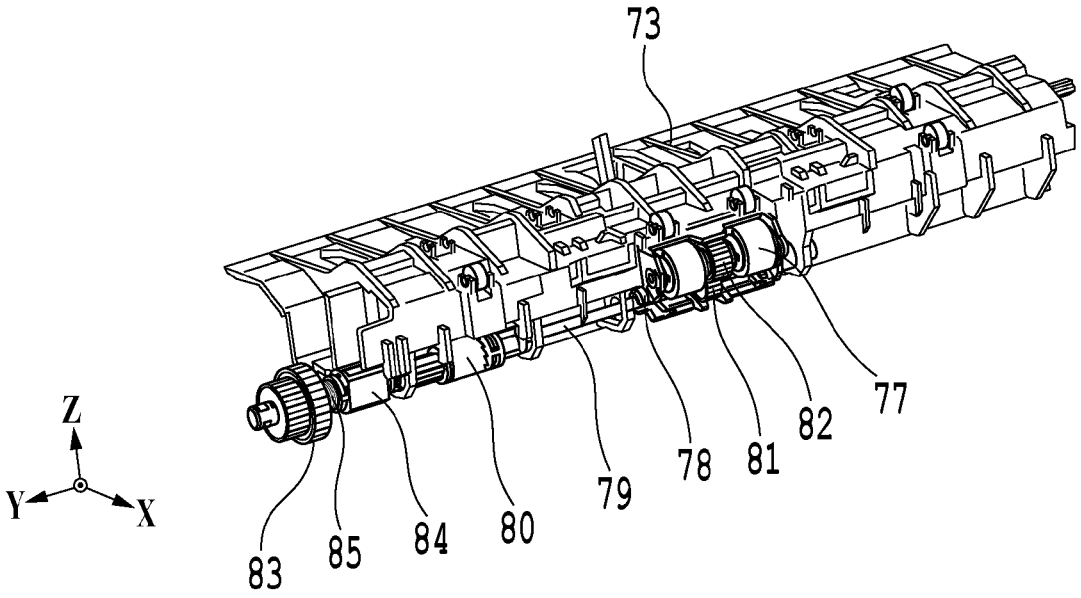
FIG. 7 is a perspective view of an inner guide unit when seen from above.
Figure 8:
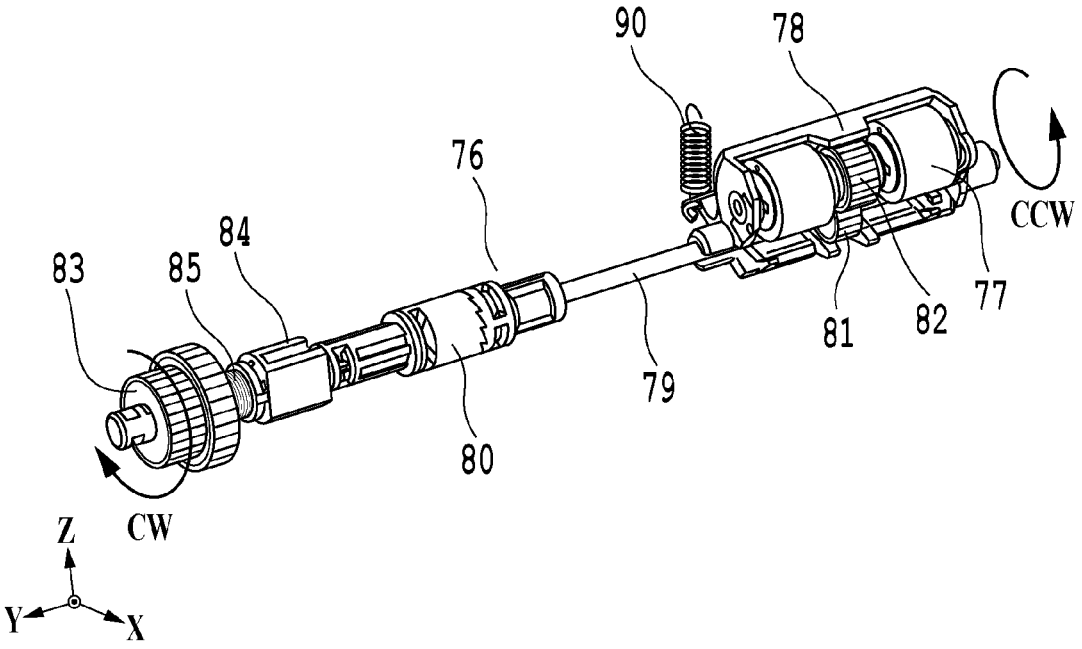
FIG. 8 is a perspective view of a PF roller unit when seen from above.
Figure 9:
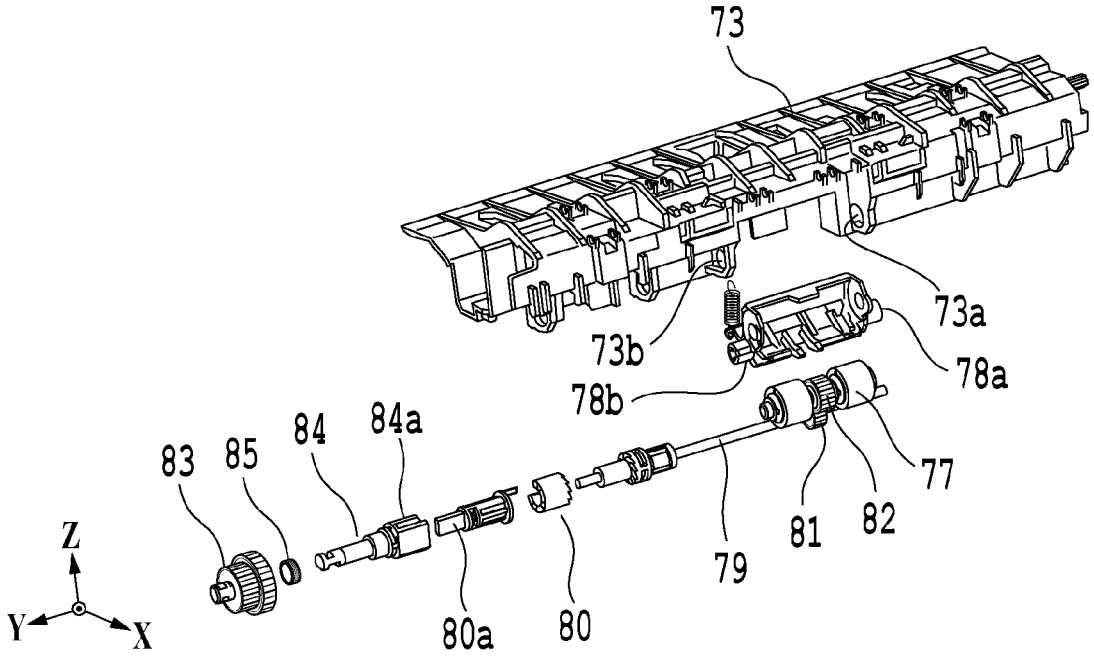
FIG. 9 is an exploded view of the inner guide unit.
Figure 10:
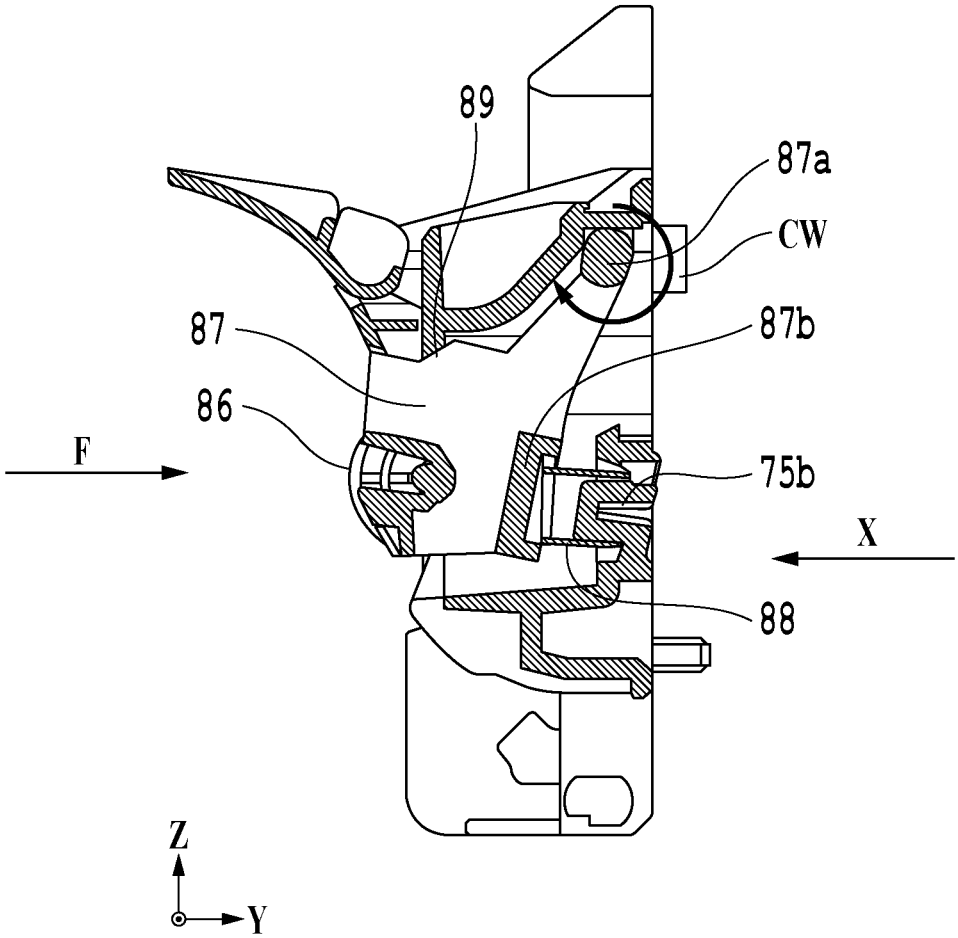
FIG. 10 is a sectional view of an outer guide unit constituting a part of the reversing conveying portion.
Figure 11:
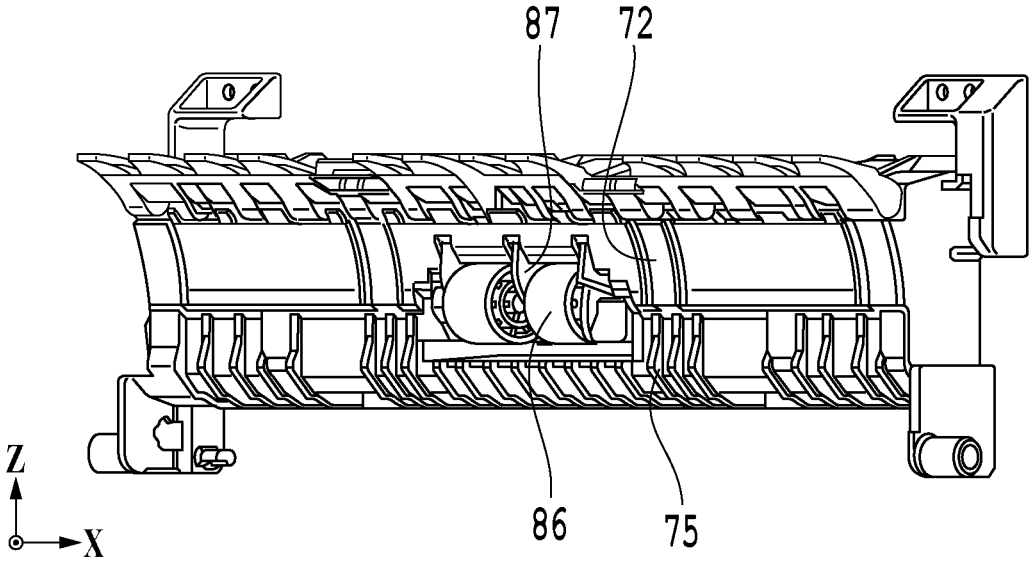
FIG. 11 is a perspective view of the outer guide unit when seen from diagonally front.

Subsequently, a configuration of the reversing conveying portion 14 will be described. FIG. 7 is a perspective view of an inner guide unit 71 constituting a part of the reversing conveying portion 14 when seen from above. FIG. 8 is a perspective view of a PF roller unit 74 when seen from the above. FIG. 9 is an exploded view of the inner guide unit 71. FIG. 10 is a sectional view of an outer guide unit 72 constituting a part of the reversing conveying portion 14. FIG. 11 is a perspective view of the outer guide unit 72 when seen from diagonally front.

The reversing conveying portion 14 is composed of the inner guide unit 71 and the outer guide unit 72. The inner guide unit 71 forms an inner guide of a reversing conveying path for reversing the print medium S and is composed of an inner guide 73 supporting each component which will be described later and the PF roller unit 74 (See FIG. 6) for conveying the print medium in the reversing conveying path. The outer guide unit 72 forms an outer guide of the reversing conveying path and conveys the print medium S in collaboration with a PF pinch roller unit 76 which will be described later.

In FIGS. 7, 8, and 9, a PF roller 77 (first conveying device) has a high friction material such as rubber on an outer periphery and is pivotally supported at the tip end of a PF arm 78. The PF arm 78 is supported capable of swing by means of shafts 78*a* and 78*b* formed integrally at the PF arm 78 pivotally supported by holes 73*a* and 73*b* of the inner guide 73. One end of a PF shaft 79 is pivotally supported by a hole formed coaxially with the shaft 78*a* of the PF arm 78, while the other end is pivotally supported by the inner guide 73 through a clutch portion 80.

In this state, the PF arm 78 is rotatable within a predetermined range by a rotation regulation portion 91 (See FIG. 6) formed on the inner guide 73 and an engagement portion of the PF arm 78. Fulcrums 78*a* and 78*b* of the PF arm 78 is set on the upstream side using a contact point between the print medium S and the PF roller 77 as a reference with respect to the conveying direction of the print medium S conveyed on the reversing conveying path. Moreover, a PF roller output gear 81 is fixed to the other end of the PF shaft 79 and is meshed with a PF roller gear 82 rotating integrally with the PF roller 77.

A flat engagement portion 80*a* is formed at one end of the clutch portion 80, while a groove 84*a* engaged with the engagement portion 80*a* is formed in a PF gear shaft 84 rotating integrally with a PF input gear 83 connected to a driving source, not shown. A clutch spring 85 is attached to the PF gear shaft 84, and rotation only in one direction is made possible by fixing one end of the clutch spring 85 to a driving frame, not shown.

With the above configuration, if the PF input gear 83 is rotated in a clockwise direction (CW direction in the figure), the clutch spring 85 is loosened, and the PF gear shaft 84 is made rotatable. Then, the rotation is transmitted to the PF shaft 79 through the engagement portion 80*a*, the groove 84*a*, and the clutch portion 80, the PF roller output gear 81 is rotated in the clockwise direction, and the PF roller gear 82 and the PF roller 77 are rotated in a counterclockwise direction (CCW direction in the figure), that is, in the conveying direction.

On the other hand, if the PF roller 77 is rotated in the conveying direction (CCW direction) in a state where driving of the PF input gear 83 is stopped, driving of the PF shaft 79 and the PF gear shaft 84 is shut off by an action of the clutch 80. Thus, a loosening torque of the clutch spring 85 does not work, and the PF roller 77 can rotate with a low driving torque. Further, if the PF roller 77 is rotated in the clockwise direction (CW direction) in a state where driving of the PF input gear 33 is stopped, the driving is transmitted to the PF gear shaft 84 by the action of the clutch portion 80, but since the clutch spring 85 is closed, rotation is made impossible.

Moreover, a precompression spring 90 (See FIG. 8) generating a biasing force in the clockwise direction (CW direction) in FIG. 6 is attached to the PF arm 78, and the PF arm 78 is stopped in a state in contact with a PF pinch roller which will be described later by an action of the precompression spring 90. In the embodiment, a biasing force of 30 gf is generated by the precompression spring 90. In FIGS. 10 and 11, the PF pinch roller 86 is pivotally supported at one end of a PF pinch roller holder 87.

The PF pinch roller holder 87 is pivotally supported capable of swing by means of a shaft 87*a* formed integrally on the PF pinch roller holder 87 pivotally supported by a hole formed in the outer guide unit 72. A PF pinch roller spring 88 is provided between a back surface 87*b* of the PF pinch roller holder 87 and an outer guide opposing portion 75*b*. Then, the back surface 87*b* is biased in an arrow X direction, and the position of the PF pinch roller holder 87 is regulated by a stopper 89 provided on the outer guide 75.

Figure 12:
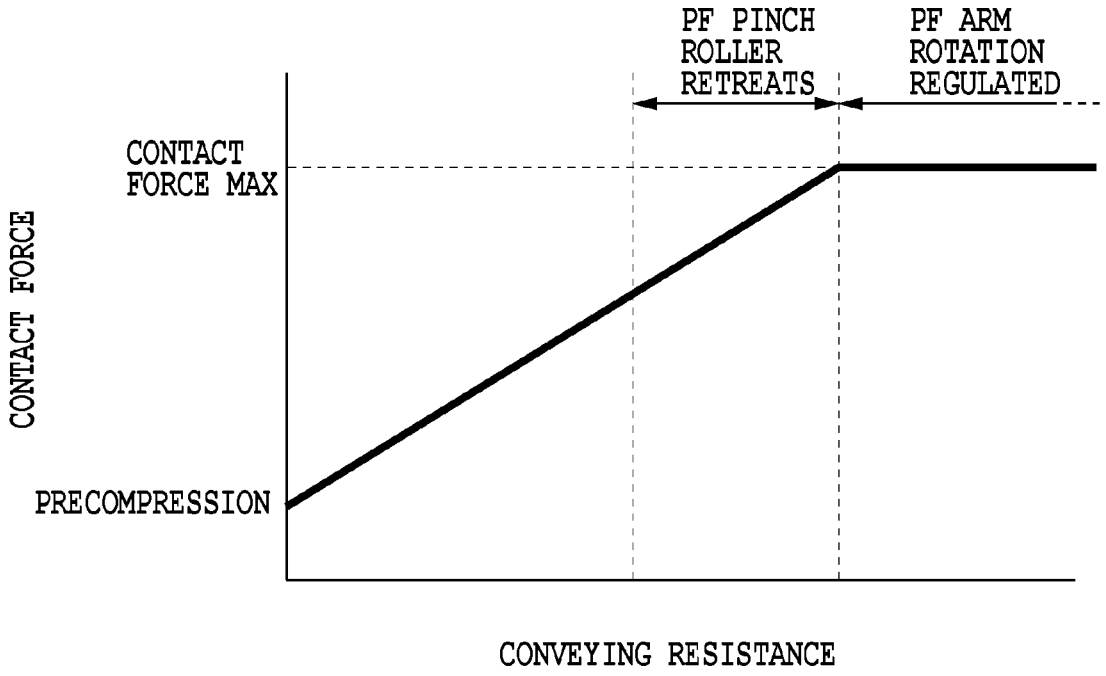
FIG. 12 is a graph illustrating a relationship between conveying resistance and a contact force between a roller and a pinch roller.

Subsequently, a relationship between conveying resistance and a contact force between the PF roller 77 and the PF pinch roller 86 will be described. FIG. 12 is a graph illustrating the relationship between the conveying resistance and the contact force between the PF roller 77 and the PF pinch roller 86 generated in accordance with the conveying resistance. In FIG. 6, a fulcrum 78*c* of the PF arm 78 is set in a direction so that a couple generated by the conveying resistance F2 of the print medium S increases a biasing force to the PF pinch roller 86 (the PF arm 78 rotates in the CW direction) and is configured such that a friction force according to the conveying resistance F2 is generated.

As illustrated in FIG. 12, the contact force between the PF roller 77 and the PF pinch roller 86 is only a force generated by the precompression spring 90 in a standby state where there is no conveying resistance. If the conveying resistance F2 increases in a print medium conveying state, the contact force is generated in accordance with the conveying resistance by the couple of the PF arm 78.

Moreover, if the conveying resistance further increases and the contact force exceeds the biasing force generated in the PF pinch roller spring 88, the PF pinch roller holder 87 rotates in the counterclockwise direction (CCW direction in the figure) around the fulcrum 87*a* and retreats. The PF arm 78 follows that and rotates in the clockwise direction (CW direction in the figure). If the resistance further increases, rotation of the PF arm 78 is regulated by the rotation regulation portion 91, and the contact force no longer increases.

(Explanation of Configuration of Horizontal Conveying Portion)

Subsequently, the horizontal conveying portion 16 (See FIG. 1) will be described. In FIGS. 1 and 2, an LF roller (second conveying device) 101 is provided on the downstream side in the conveying direction with respect to the PF roller 77 and is configured such that the surface of a metal shaft is coated with ceramic micro particles, and a metal portion of both shaft ends is supported by a bearing portion attached to a chassis.

On a pinch roller holder 103, a plurality of pinch rollers 105 biased to the surface of the LF roller 101 by a pinch roller spring 104 are held, and the pinch roller 105 is brought into contact with the surface of the LF roller 101 and follows it. A discharge roller 106 is configured such that a plurality of rubber rollers are inserted into a metal shaft and fixed.

A plurality of spurs are attached to a spur holder 107, and these spurs are pressed toward the discharge roller 106 by a spur spring in which a coil spring is provided in a rod state. A platen 108 is configured to support the lower surface of the print medium S between the LF roller 101 and the discharge roller 106.

(Explanation of Configuration of Origin Seeking Device and Explanation of Operation of Origin Seeking Device)

Subsequently, a configuration of origin seeking device of the LF roller 101 will be described. An LF slider guide is rotatably attached with friction to an outer periphery of the LF roller 101. An engagement portion is integrally formed on the LF slider guide, and a rotating angle is regulated by engagement between a first stopper and a second stopper formed on a left side chassis. If the LF roller rotates normally (counterclockwise direction), the engagement portion and the first stopper are brought into contact with each other, the LF slider guide is stopped, and only the LF roller rotates.

On the other hand, if the LF roller 101 rotates reversely (clockwise direction), the rotation of the LF slider guide is stopped at a position where the engagement portion and the second stopper are brought into contact with each other, and only the LF roller 101 rotates. The LF slider is attached capable of rotation and sliding in the rotating direction and the axial direction with respect to the outer periphery of the LF roller 101. The LF slider is molded from a material with low friction with respect to metal (POM in the embodiment) and is capable of rotation and sliding with a low load. By engaging a rib formed on the LF slider guide with a groove in the LF slider, the LF slider rotates in synchronization with the LF slider guide.

In the LF roller gear, a projection engaged with a tip end portion of the LF slider is formed. In the above configuration, if the LF roller gear is rotated in the clockwise direction in a state where the LF slider is made to slide to an origin seeking position where the tip end portion is engaged with the projection, the tip end portion is brought into contact with the projection, and the LF roller 101 can no longer rotate. And this position is stored as an origin in a main body. When origin seeking is finished, the LF slider slides to a position where the LF roller gear can rotate by its own weight.

(Explanation of Configuration of Driving Row)

Figure 13:
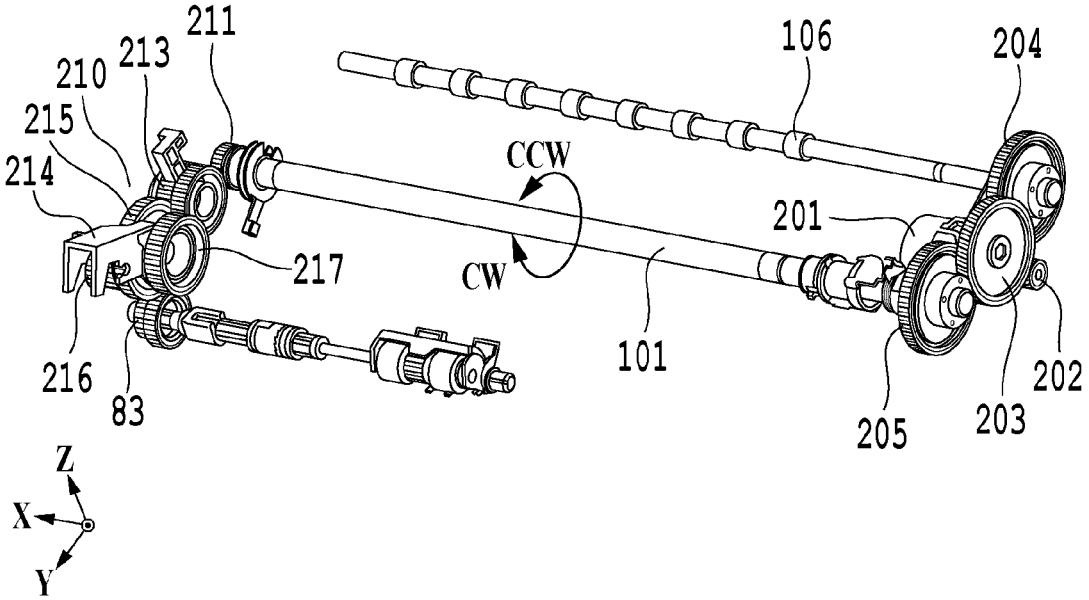
FIG. 13 is as perspective view of an entire driving row driving a PF roller, an LF roller, and a discharge roller when seen from a rear part above.
Figure 14:
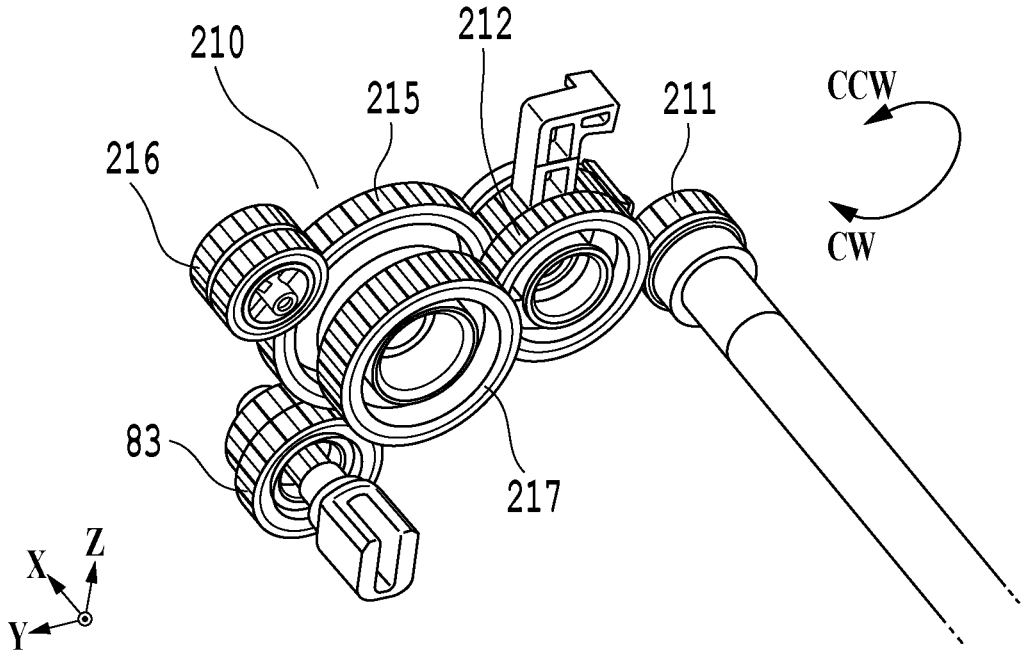
FIG. 14 is a perspective view of the driving row for transmitting driving from the LF roller to the PF roller unit when seen from above.
Figure 15:
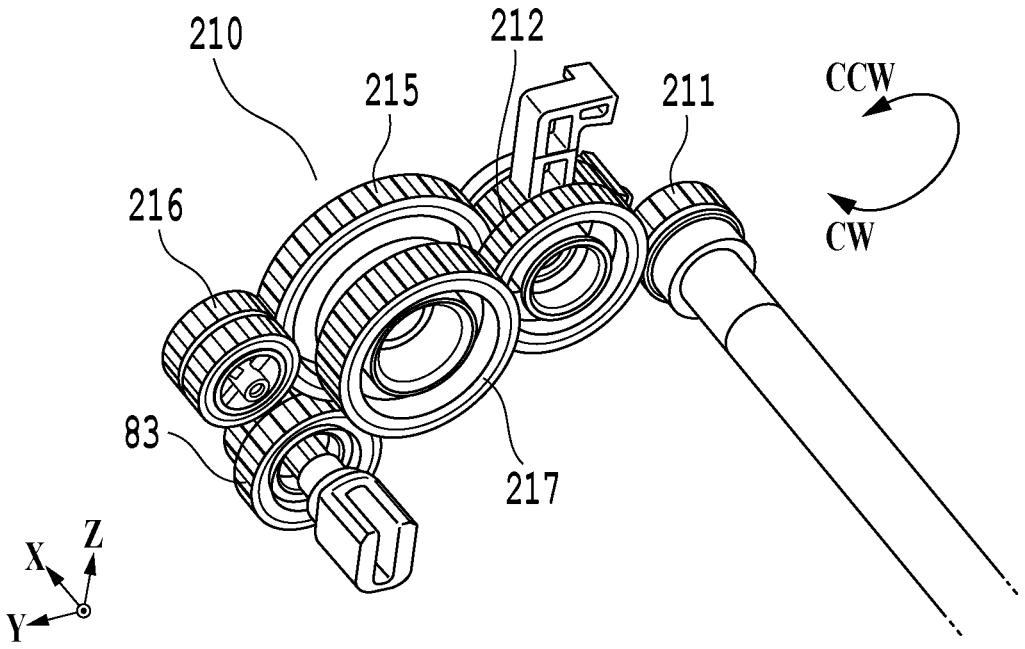
FIG. 15 is a perspective view of the driving row for transmitting driving from the LF roller to the PF roller unit when seen from above.

Subsequently, a configuration of a driving row will be described. FIG. 13 is a perspective view of an entire driving row for driving the PF roller 77, the LF roller 101, and the discharge roller 106 when seen from the rear part above. FIGS. 14 and 15 are perspective views of the driving row for transmitting driving from the LF roller 101 to the PF roller unit 74 when seen from above. Driving of a motor 201 which is a driving source is transmitted to a discharge roller gear 204 attached to one end of the discharge roller 106 through a pinion gear 202 and an idler gear 203. Moreover, the idler gear 203 is also connected to an LF roller gear 205 attached to one end of the LF roller 101, and the driving from the motor 201 is also transmitted to the LF roller 101 at the same time.

A rotation ratio between the LF roller 101 and the discharge roller 106 is configured to be 1:1. In addition, the rotation ratio between the LF roller gear 205 and the discharge roller gear 204 is also configured to be 1:1. As configured as above, a rotation cycle of the LF roller 101 becomes equal to the rotation cycle of the discharge roller 106 and the rotation cycle of a transmission gear, and a conveying amount error caused by eccentricity of the roller also occurs with the same cycle as roller rotation. A cord wheel having slits formed at a pitch of 150 to 360 lpi is directly connected coaxially with the LF roller 101. And the number of times and timing of passage of the slit on the cord wheel are read by an LF roller encoder sensor, and a rotation amount and a rotation speed of the driving motor are controlled.

On the side opposite to the driving source sandwiching the LF roller 101 between them, a PF roller driving row 210 for transmitting driving to the PF roller 77 is arranged. The PF roller driving row 210 is composed of an LF output gear 211 attached to the other end of the LF roller 101, an idler gear 212, a pendulum gear unit 213, and the PF roller gear 82. The pendulum gear unit 213 is composed of a pendulum arm 214, a planetary gear 216, and a transmission gear 217 attached coaxially with a sun gear 215 through a one-way clutch. The one-way clutch can transmit the driving to the transmission gear 217 when the sun gear 215 rotates in the clockwise direction in the figure.

If the LF roller 101 rotates normally (rotation in the CW direction in the figure), the driving is transmitted to the sun gear 215 through the LF output gear 211 and the idler gear 212, the sun gear 215 and the pendulum arm 214 rotate in the CW direction, and the planetary gear 216 rotates in the CCW direction. The pendulum arm 214 rotates in the CW direction and is brought into contact with a stopper, not shown, and stopped. Then, the driving is transmitted to the transmission gear 217 by the one-way clutch, and the PF input gear 83 rotates in the CCW direction.

If the LF roller 101 rotates reversely (rotation in the CCW direction in the figure) from this state, the sun gear 215 and the pendulum arm 214 are rotated in the CCW direction, and the planetary gear 216 is stopped by a stopper, not shown, at a position meshed with the PF input gear 83. Then, the PF input gear 83 is rotated in the CW direction by the planetary gear 216. At this time, the transmission gear 217 rotates in the CW direction by means of the PF input gear 83, which is made possible since the driving from the sun gear 215 is not transmitted by the action of the one-way clutch.

That is, a delay mechanism is provided in which, if the LF roller 101 switches from normal rotation to reverse rotation, the PF input gear 83 is stopped once, the LF roller 101 is rotated by a predetermined amount and then, starts rotation.

On the other hand, when the LF roller 101 switches from the reverse rotation to the normal rotation, the driving is immediately transmitted to the PF input gear 83 without a time difference of the delay time. A predetermined amount of rotation of the LF roller 101 at that time is determined by a rotation angle of the pendulum arm 214 determined by the stopper of the pendulum arm 214. The predetermined amount in the embodiment is set so that, when the LF roller 101 is rotated by 130 degrees (11 mm in the conveying length), the driving is transmitted to the PF input gear 83.

(Explanation of Operation from Sheet Feeding to Discharge)

Subsequently, an operation from sheet feeding to discharge will be described. Speed ratios of the print medium conveyed by the sheet feeding roller 51, the PF roller 77, the LF roller 101, and the discharge roller 106 are set as follows:

When the LF roller 101 is rotating normally:

Sheet feeding roller:PF roller:LF roller:discharge roller=0.6:0.6:1:1, when the LF roller 101 is rotating reversely:

PF roller:LF roller:discharge roller=1:1:1.

First, before feeding the print medium, an origin position of the LF roller 101 is detected by the origin seeking device, and a phase of the LF roller 101 is made obtainable all the time. Subsequently, sheet feeding is started by means of normal rotation of the sheet-feeding roller 51, the PF roller 77, and the LF roller 101. Then, from the bundle of the print mediums S set with a surface (that is, an image printing surface or an image reading surface) faced downward on the loading portion 11, one uppermost print medium is separated by means of an action of the sheet feeding roller 51 and the separation bank surface 61. The separated print medium S passes through a guide surface of a double-sided discharge flapper 114 by the sheet feeding roller 51 and enters the reversing conveying path.

The print medium S then reaches a nip portion between the PF roller 77 and the PF pinch roller 86 and is conveyed further to the downstream by the PF roller 77. If the print medium S is conveyed by the predetermined amount from the PF roller nip portion, driving of the sheet feeding roller 51 is shut off and stopped. Subsequently, when the print medium S is conveyed to the downstream of the reversing conveying path by the PF roller 77, the print medium detecting device (detecting device) 221 detects the tip end of the print medium S, detects the phase of the LF roller at that time by the phase detecting device, and stores the detected result.

Then, after performing the skew correcting operation of the print medium and a phase matching operation for matching the phase of the LF roller and the position of the print medium S, the print medium S is conveyed to an image forming position. The print medium S having been conveyed to the image forming position is conveyed to the downstream by the LF roller 101 and the discharge roller 106, and an image is formed by the image forming portion 17. When image formation is then finished, the print medium S is discharged by the discharge roller 106.

Subsequently, the skew correction and the LF roller phase matching will be described by using the figures. The LF roller phase matching is performed so that a phase of the LF roller 101 when the rear end of the print medium exits the LF roller 101 becomes optimal with few conveying errors. The phase when the print medium S exits the LF roller 101 is calculated from the phase when the print medium S is bitten by the LF roller 101 and the print medium length.

Since he length of the print medium S is determined in advance by the print medium S to be set, the phase matching is realized by controlling the phase when the print medium S is bitten by the LF roller 101 so that the phase when the print medium S exits the LF roller 101 becomes optimal.

FIGS. 16 to 22 are facilitated sectional views describing a curved path of the print medium S in a manner facilitated to a straight path in order to facilitate understanding of the LF phase matching operation. A curved path as in FIG. 2 also functions similarly.

Figure 16:
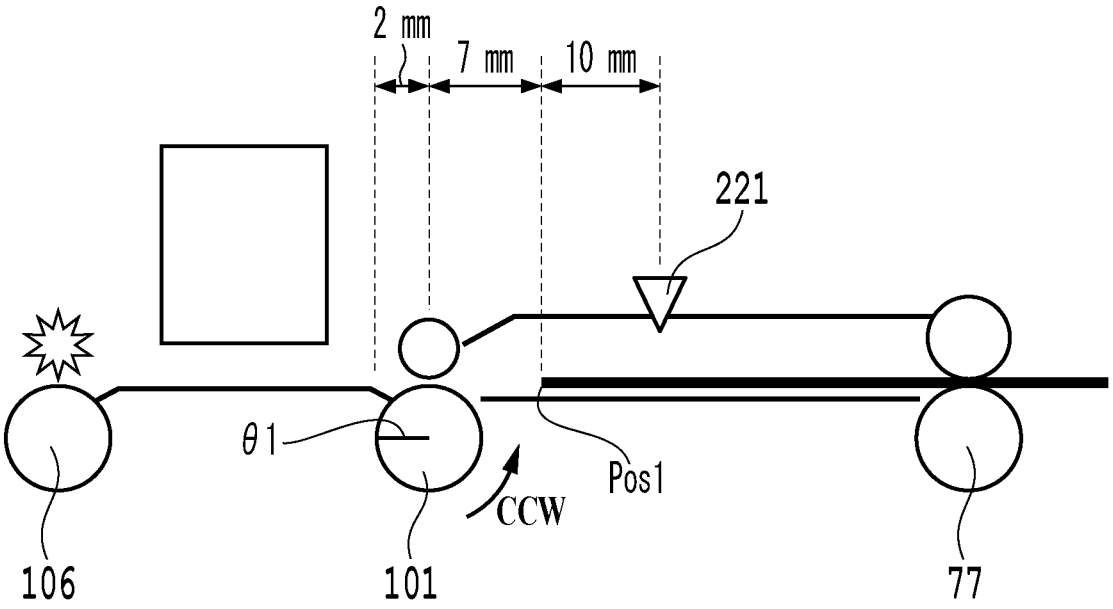
FIG. 16 is a facilitated sectional view describing a curved path of a print medium in a manner facilitated to a straight path.

First, the tip end of the print medium S having been conveyed by the PF roller 77 is detected by the print medium end portion detecting device 221 and the phase of the LF roller 101 at that time is stored at the same time. As a result, the position of the print medium S and the phase of the LF roller 101 in the conveying path can be recognized. Then, after the print medium S has been conveyed by 10 mm from the tip end detected position, the PF roller 77 and the LF roller 101 are stopped (FIG. 16).

Figure 17:
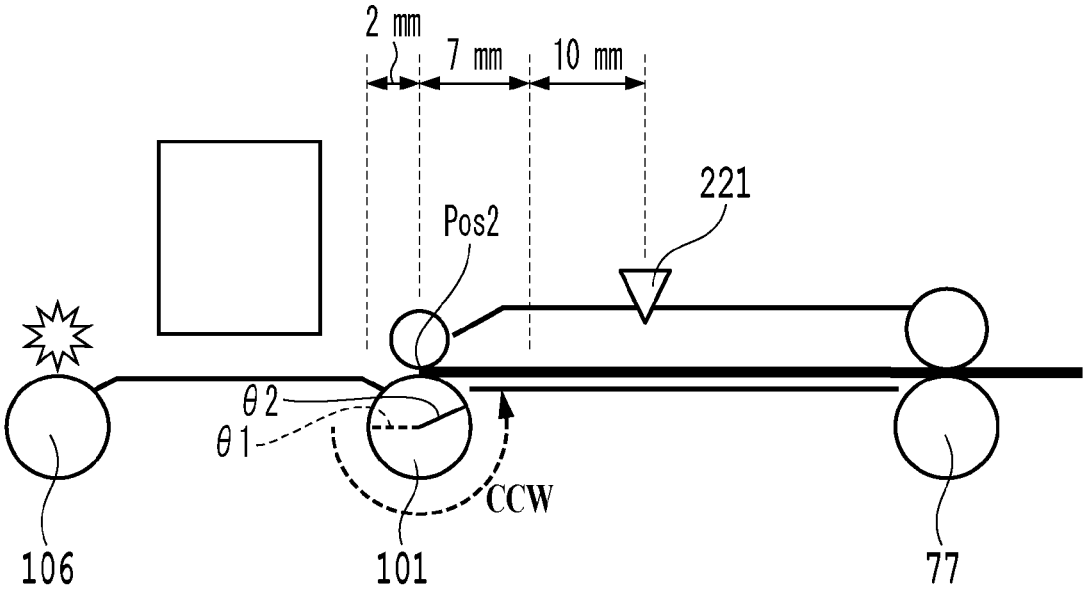
FIG. 17 is a facilitated sectional view describing the curved path of the print medium in a manner facilitated to the straight path.

The tip end position of the print medium S at this time is referred to as Pos1 and the phase of the LF roller 101 to θ1. Further, the LF roller 101 is rotated α1 normally (CCW direction in the figure) and the print medium S is conveyed, and the print medium position when the tip end of the print medium S is brought into contact with the LF roller nip is referred to as Pos2 and the phase of the LF roller to θ2 (FIG. 17). Here, a distance from the print medium end portion detecting device 221 to the nip of the LF roller 101 is set to 17 mm.

Figure 18:
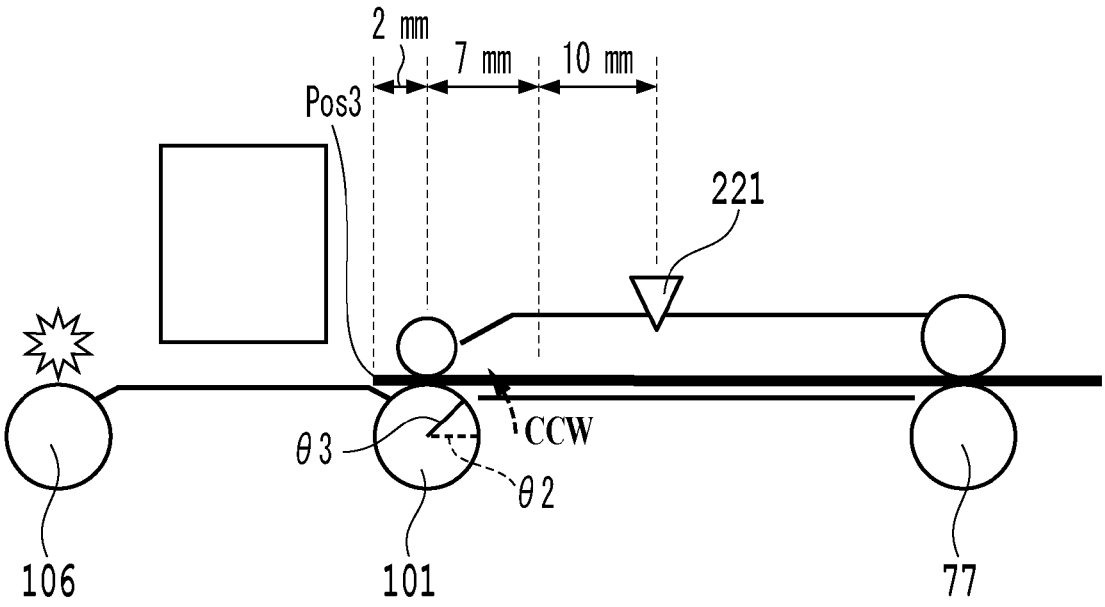
FIG. 18 is a facilitated sectional view describing the curved path of the print medium in a manner facilitated to the straight path.
Figure 19:
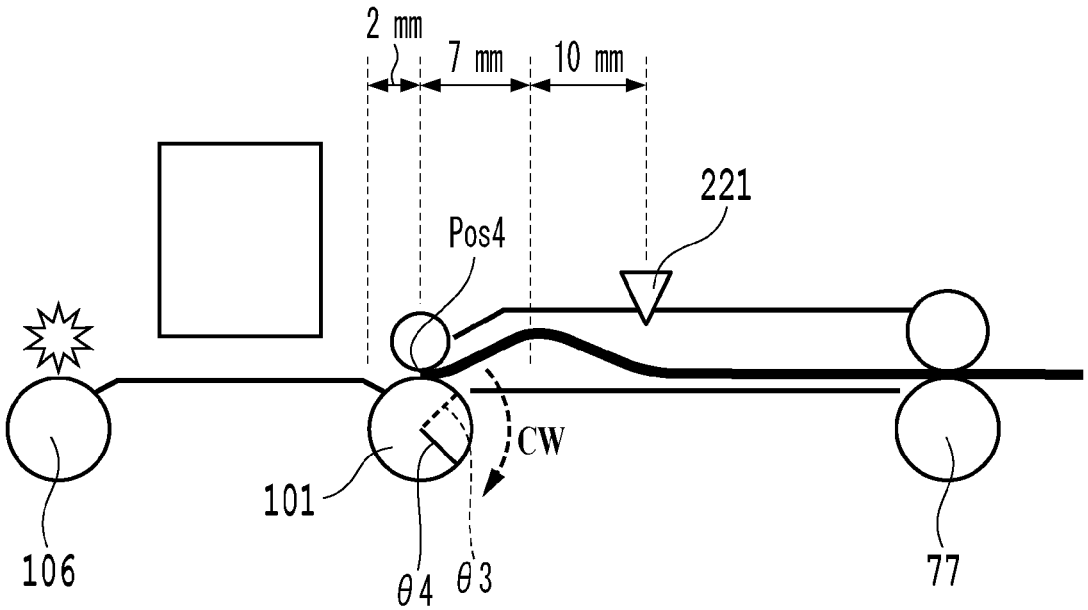
FIG. 19 is a facilitated sectional view describing the curved path of the print medium in a manner facilitated to the straight path.

Further, the LF roller 101 is normally rotated α2 (CCW direction in the figure) and when the tip end of the print medium passes 2 mm from the LF roller nip, the LF roller 101 is stopped (FIG. 18). The print medium position at this time is referred to as Pos3 and the phase of the LF roller 101 to θ3. Then, the LF roller 101 is reversely rotated α3 (CW direction in the figure) only by 6 mm in the conveying length, the print medium tip end is returned to the nip of the LF roller 101, and skew is corrected by the correcting device (FIG. 19).

The print medium position at this time is referred to as Pos4 and the phase of the LF roller 101 to θ4. Here, assuming that the diameter of the LF roller 101 is 9.6 mm and normal rotation (CCW direction in the figure) of the LF roller is +, the following is obtained from the above-described peripheral speed difference between the LF roller and the PF roller:

$$\theta 2=\theta 1+\alpha 1=\theta 1+197^\circ$$

$$\theta 3=\theta 2+\alpha 2=\theta 2+24^\circ$$

$$\theta 4=\theta 2-\alpha 3=\theta 3-71^\circ$$

If θ4 is expressed as θ1, assuming that $$\theta 4=\theta 1+\alpha 1+\alpha 2-\alpha 3=\theta 1+197+24-71=\theta 1+150^\circ$$

$$\alpha 1+\alpha 2-\alpha 3=\alpha,$$

$$\theta 4=\theta 1+\alpha.$$

However, since the phase is 0 to 359°, if 359° (one rotation) is exceeded, 360° is subtracted.

That is, the phase of Pos4 becomes a phase advanced by 150° with respect to the phase of the LF roller 101 at Pos1. Here, the phase of the LF roller 101 to be aligned with the print medium tip end is set to θ5, and a reverse rotation amount R required for matching the LF roller 101 to θ5 by reverse rotation (rotation in the CCW direction) from the phase of θ4 can be expressed as follows:

$$R=\theta 4-\theta 5=\theta 1+150°-\theta 5$$

$$\theta 5=\theta 4-R=\theta 1+\alpha-R$$

Figure 20:
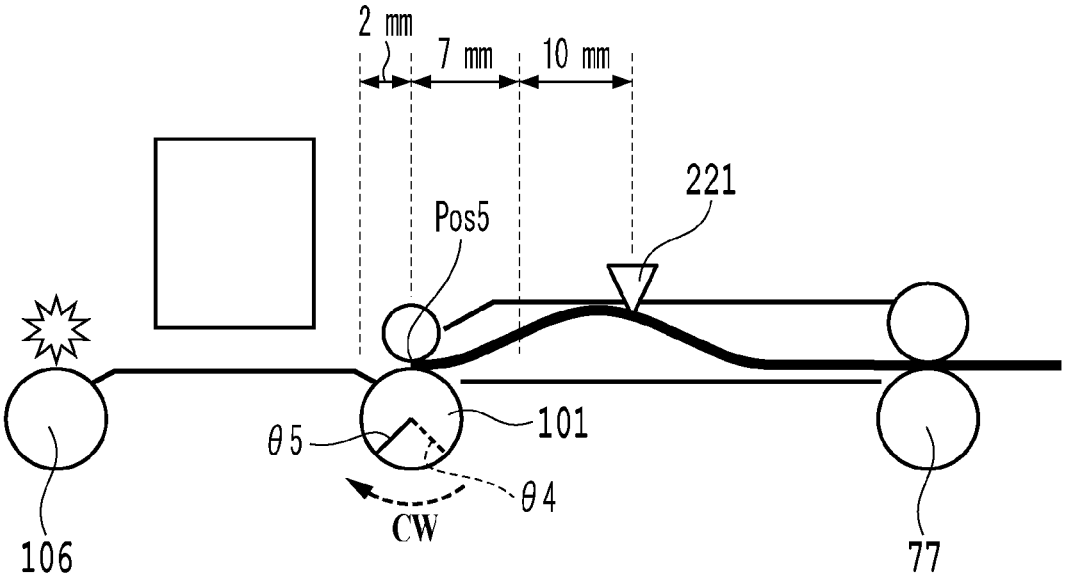
FIG. 20 is a facilitated sectional view describing the curved path of the print medium in a manner facilitated to the straight path.
Figure 21:
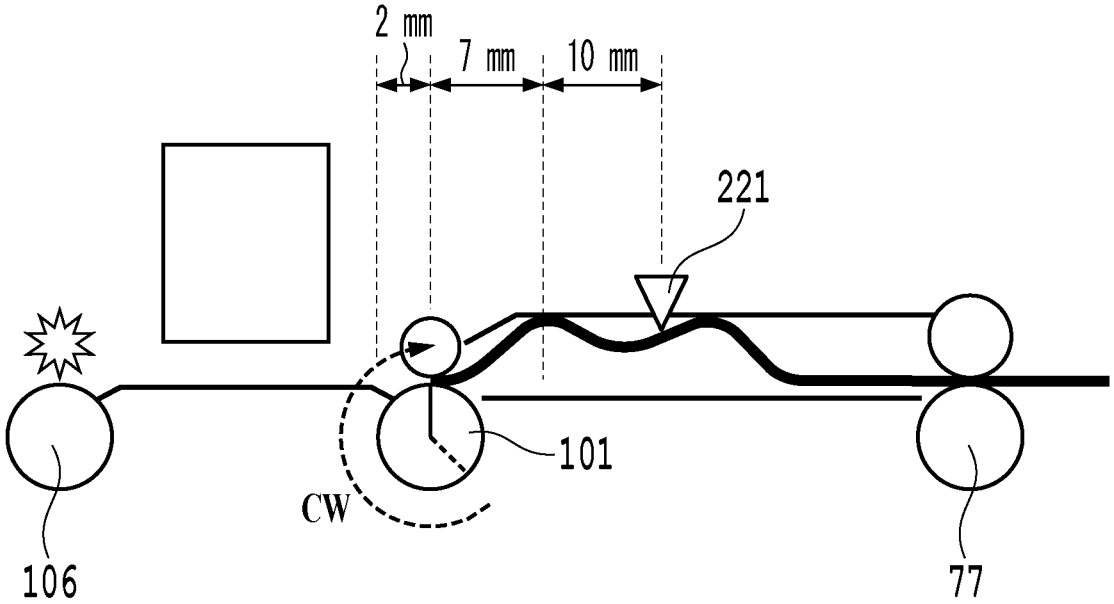
FIG. 21 is a facilitated sectional view describing the curved path of the print medium in a manner facilitated to the straight path.

The skew can be corrected by rotation by adding this reverse rotation amount R to a reverse rotation amount of skew correction, and the LF roller 101 can be matched to a predetermined phase (FIG. 20).

However, as described above, if the LF roller 101 is reversely rotated by 130° or more, the PF roller 77 starts normal rotation and thus, by considering the reverse rotation amount at θ4 above, the print medium S is conveyed by the PF roller 77 if R exceeds 59°, and a loop becomes larger. This is because 130° (the rotation angle of the delay)−71° (the reverse rotation angle of the LF roller at the time of the formation of the skew correcting loop)=59°.

A maximum allowable loop amount at this time is decided by the skew correcting capability and a sheet path. For example, if the loop becomes excessively large as in FIG. 21, a direction of a force acting by the loop changes, and the tip end cannot be pressed to the LF roller 101 or cannot be bitten any longer when the LF roller 101 normally rotates, and the skew correcting capability deteriorates.

Moreover, a problem that the loop is brought into contact with the sheet path and is buckled also occurs. Furthermore, if the reverse rotation amount of the LF roller 101 after the skew correction increases, a problem of damage on the print medium tip end also occurs. Since the allowable maximum loop amount excluding 2 mm of the skew correction in the embodiment is 7 mm, reverse rotation by 143° in addition to the reverse rotation amount of the skew correction in the LF roller 101 is possible. This is based on the equation: 360°×7 mm/(9.6 mm×π)+59°=143°.

Here, the maximum value of the reverse rotation amount decided by the allowable maximum loop amount is assumed to be θmax.

In the case where the LF roller is matched to the desired phase θ5 at Pos4, the LF roller need be further reversely rotated by an angle R. Here, the LF roller cannot be reversely rotated at a greater angle than θmax. When R is equal to or smaller than θmax, the LF roller is reversely rotated at the angle R at Pos4, so that the phase of the LF roller can be matched to θ5.

Figure 22:
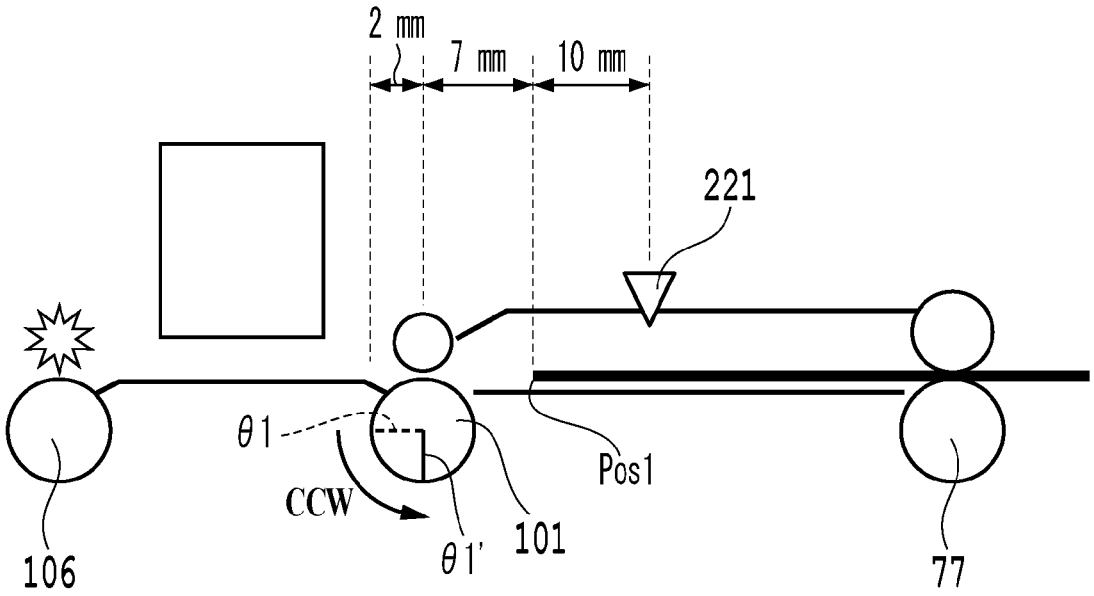
FIG. 22 is a facilitated sectional view describing the curved path of the print medium in a manner facilitated to the straight path.

However, in order to match the LF roller 101 to an arbitrary phase, reverse rotation of 359° at the maximum is required. Thus, if the reverse rotation amount R exceeds 143° which is θmax, the LF roller 101 is reversely rotated by R−θmax (143°) before transition from Pos1 to Pos2, and the phase of θ1 is moved to θ1' (FIG. 22). Here, when R−θmax exceeds the rotation angle (130°) of the delay, the print medium is adversely conveyed. Therefore, it is the rotation angle (130°) of the delay at most that the LF roller 101 can be reversely rotated in the state in which the tip end of the print medium is positioned at Pos1. When R−θmax is greater than the rotation angle (130°) of the delay, the LF roller 101 is rotated by 130° at Pos1. In contrast, when R−θmax is equal to or smaller than the rotation angle (130°) of the delay, the LF roller 101 is reversely rotated by R−θmax at Pos1, so that the phase is changed to θ1'. Thus, the reverse rotation amount R in the LF phase matching becomes 143°.

When R−θmax is equal to or smaller than 130°, since the PF roller 77 does not rotate due to the delay mechanism at this time, only the phase θ1 of the LF roller 101 can be changed to θ1' while the print medium position Pos1 remains as it is. When R−θmax is greater than 130°, the LF roller 101 is rotated by the rotation angle (130°) of the delay at Pos1. Next, the LF roller is rotated forward at the rotation angle (130°) of the delay or greater, and thus, the delay is accumulated. For example, the sheet is conveyed up to Pos2, that is, the LF roller is rotated by 197°, so that the delay of 130° is accumulated. Therefore, the LF roller is reversely rotated at Pos2 by R−the rotation angle (130°) of the delay−θmax (143°)=R−273. Also here, it is the rotation angle (130°) of the delay at most that the LF roller can be reversely rotated. When the rotation angle of the delay is 130°, the LF roller 101 is reversely rotated by R−273. Also here, the LF roller can be rotated within 130°. Thus, R can be covered within 359°.

Namely, the rotation angle of the delay is assumed to be θdel, the LF roller is reversely rotated by θdel at Pos1; by R−θdel−θmax at Pos2; and by θmax at Pos4.

$$\theta 1+\alpha-\theta del-(R-\theta del-\theta max)-\theta max=\theta 1+\alpha-R=\theta 5$$

When the rotation angle of the delay is small, and further, $$R-\theta del-\theta max>\theta del,$$

the LF roller is reversely rotated at θdel a plurality of times (n times) without any reverse conveyance of the print medium until the print medium reaches Pos2. When $$R-n\times\theta del-\theta max>\theta del,$$

the LF roller is reversely rotated by R−n×θdel−θmax, and then, it is reversely rotated by θmax at Pos4.

$$\theta 1+\alpha-n\times\theta del-(R-n\times\theta del-\theta max)-\theta max=\theta 1+\alpha-R=\theta 5$$

The phase matching operation as above is performed once or several times.

Figure 23:
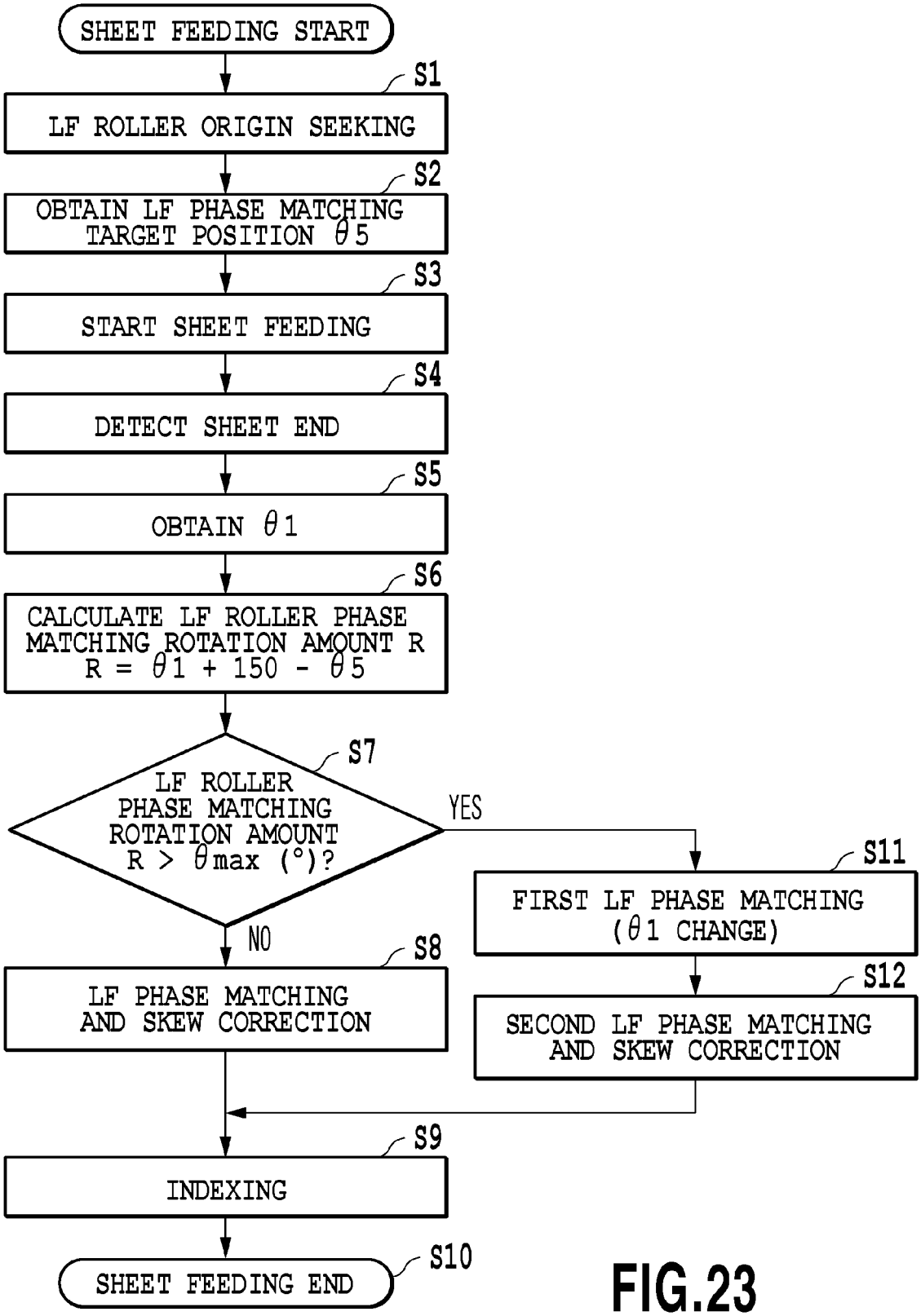
FIG. 23 is a flowchart illustrating a sheet feeding operation in phase matching.

Subsequently, a flow of skew correction and phase matching will be described by using a flowchart. FIG. 23 is a flowchart illustrating a sheet feeding operation when the phase matching is performed. When the sheet feeding is started, first, in step S1, the origin seeking of the LF roller 101 is performed by the LF roller origin seeking device, and a current phase of the LF roller is made obtainable by slit information of the cord wheel.

Subsequently, in step S2, a target phase θ5 of the LF roller phase matching is obtained. Then, each roller is driven in step S3, and sheet feeding is started. When the print medium S exceeds the PF roller 77 and the tip end thereof reaches the print medium end detecting device 221, the print medium end portion is detected in step S4. At the same time, the LF roller phase at that time is detected, and the print medium end portion and the LF roller phase are made controllable. Then, at a position where the print medium tip end exceeds the print medium detection portion and is conveyed by a predetermined amount (10 mm in the embodiment), the conveying is stopped.

Then, in step S5, the LF roller phase θ1 at this time is obtained. Subsequently, in step S6, the above-described LF roller phase matching rotation amount R (θ1+150°−θ5) is calculated from the obtained θ1 and θ5. After that, in step S7, it is determined in comparison whether or not the rotation amount R is larger than θmax determined by the allowable maximum loop amount. If R is smaller than θmax, the LF phase matching and skew correction are performed in step S8.

After that, in step S9, indexing is performed, and sheet feeding is finished. On the other hand, if R is larger than θmax in step S7, the program proceeds to step S11, moves the phase of the LF roller only by R−θmax by reversing the LF roller (first phase matching) and changes the phase of θ1 so that the phase matching rotation amount R becomes smaller than θmax. After that, in step S12, second LF roller phase matching and skew correction are performed. Then, in step S9, indexing is performed, and sheet feeding is finished.

Figure 24:
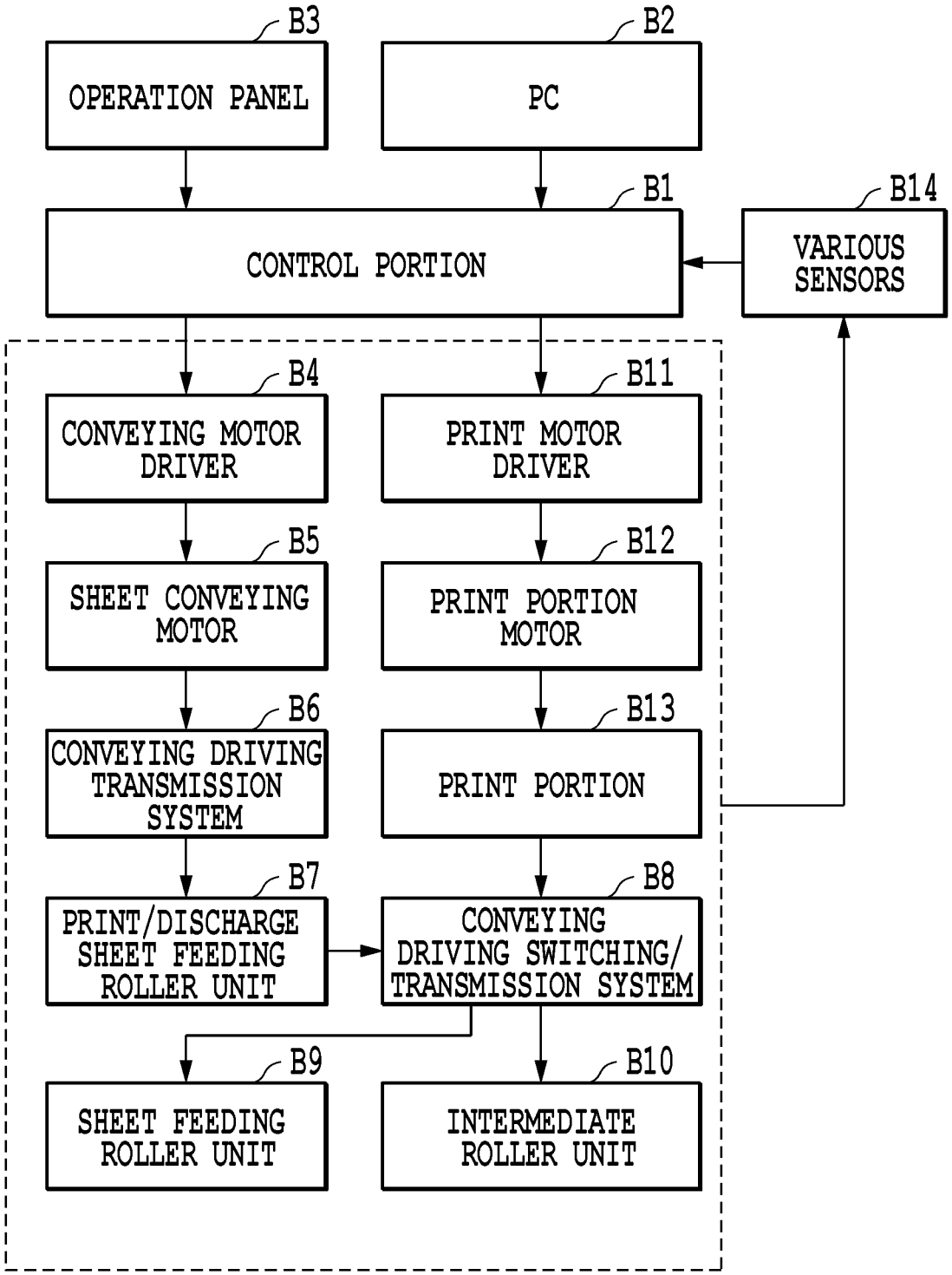
FIG. 24 is a block diagram illustrating an outline of printing operation control of an inkjet printing apparatus.

FIG. 24 is a block diagram illustrating an outline of printing operation control of an inkjet printer product to which the embodiment is applied when an inkjet printing apparatus is used for the image forming portion. When a control portion B1 receives a printing instruction from a PC (B2) or an operation panel B3 or performs an operation by a timer or the like in the control portion B1, the control portion B1 issues an instruction to supply power to a conveying motor B5 connected to a conveying driving transmission system B6 through a driver B4.

In parallel, an instruction is given to supply power also to a printing portion motor B12 connected to a printing portion B13 through a printing portion motor driver B11. Moreover, the printing portion B13 is connected so that driving switching of a conveying driving switching/transmission system B8 is performed by the operation thereof. Furthermore, a printing feeding roller unit and a discharge roller unit B7 to which driving is transmitted from the conveying motor B5 through the conveying driving transmission system B6 are configured to be able to convey the print medium S in printing and to transmit a rotation driving force to the conveying driving switching/transmission system B8.

The conveying driving switching/transmission system B8 transmits the driving force transmitted from the printing feeding roller unit and the discharge roller unit B7 to a sheet feeding roller unit B9 and an intermediate roller unit B10 by switching presence or absence of driving transmission and a rotating direction by an operation of the printing portion B13. A rotation state and a load state of each motor and a conveying state of a print medium are detected by various sensors B14 provided at each spot in a printer, and information is sent to the control portion B1 in a form of a signal. The control portion B1 performs printing by controlling each motor on the basis of the instruction and the sensor information.

(Another Embodiment)

The description has been given of the adjustment of the phase of the LF roller that is reversely rotated for the purpose of the skew correction in the above-described embodiment. Another description will be given below of the adjustment of the phase of the roller that is not reversely rotated.

Figure 25A:
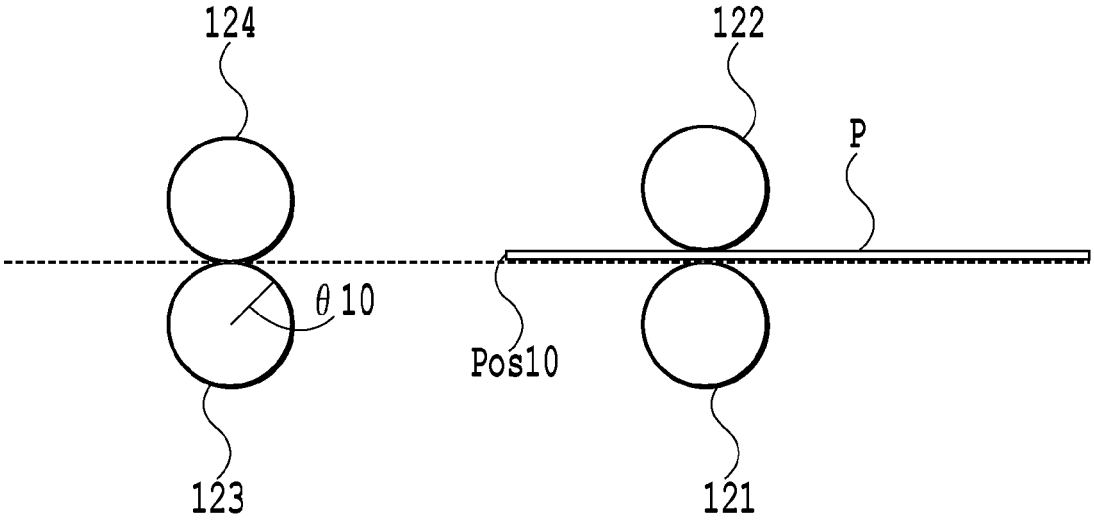
FIG. 25A is a facilitated sectional view describing the curved path of the print medium in a manner facilitated to the straight path.
Figure 25B:
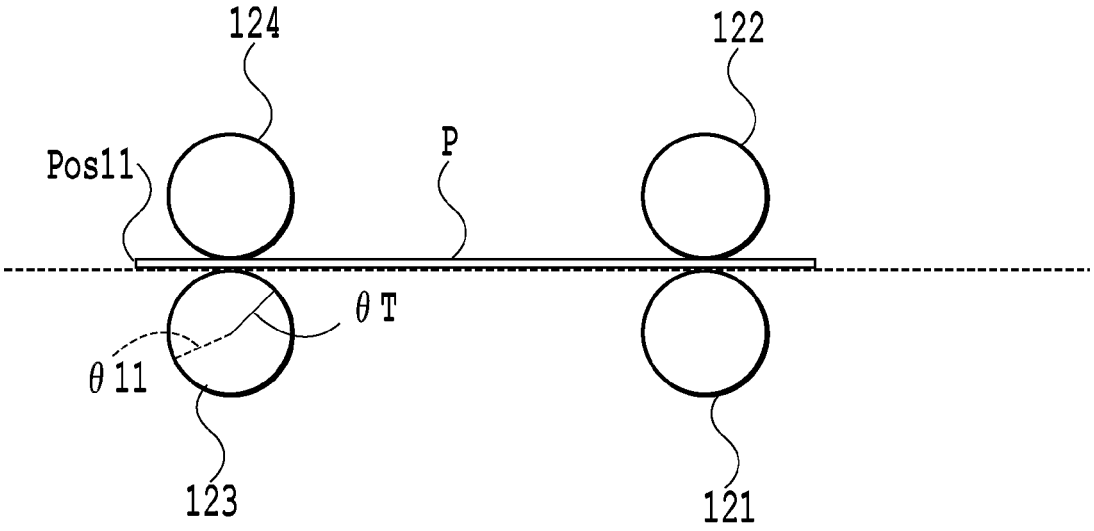
FIG. 25B is a facilitated sectional view describing the curved path of the print medium in a manner facilitated to the straight path.

In FIGS. 25A and 25B, reference numeral 121 designates a first roller, and 122 denotes a pinch roller that holds a sheet in cooperation with the first roller 121. Moreover, reference numeral 123 designates a second roller located at a position downstream of the first roller in the conveying direction, and 124 denotes a pinch roller that holds a sheet in cooperation with the second roller 123.

Like the above-described embodiment, the first roller and the second roller are driven by a motor serving as a common driving source. In the same manner as the above-described embodiment, the rotation of the driving source is transmitted to the first roller by a transmitting device including a delay mechanism. The delay mechanism can accumulate a delay angle in such a manner that the first roller cannot be rotated even if the second roller is reversely rotated by θdmax at the maximum.

In FIG. 25A, a sheet P is held between the first roller 121 and the pinch roller 122. The tip end of the sheet P is located at a position Pos10 upstream of a nip defined between the second roller 123 and the pinch roller 124. The driving source for the first roller 121 and the pinch roller 122 is forward rotated at this position, so that the sheet P is conveyed until the tip end of the sheet P reaches a position Pos11 downstream of the nip defined between the second roller 123 and the pinch roller 124. In the case where the phase of the second roller 123 is not adjusted, the phase of the second roller is assumed to be θ11, and therefore, the second roller 123 is assumed to be rotated by α10.

$$\theta 11=\theta 10+\alpha 10$$

Assuming that the target phase of the second roller 123 when the tip end of the sheet P reaches Pos11 is assumed to be θT, $$\theta T=\theta 11+R2.$$

In the case where 360°−R2≤θdmax, the second roller 123 is reversely rotated by (360°−R2) when the tip end of the sheet P is located at Pos10, so that the phase of the second roller 123 is changed from θ10 to θ10'.

$$\theta 10'=\theta 10-(360°-R2)$$

Since 360°−R2≤θdmax, the tip end of the sheet P remains located at Pos10. Next, the second roller 123 is rotated by α10, the tip end of the sheet P reaches Pos11. At this time, the phase of the second roller 123 is:

$$\theta 10'+\alpha 10=\theta 10-(360°-R2)+\alpha 10=\theta 10+\alpha 10+R2-360°=\theta 11+R2-360°=\theta T-360°$$

Here, θT−360° is equal to θT from the viewpoint of the phase, and therefore, the phase of the second roller 123 has been adjusted to θT.

Even if the second roller 123 is reversely rotated by (360°−R2) at any timings after the tip end of the sheet P is conveyed from Pos10 and before it is held at the nip defined between the second roller 123 and the pinch roller 124, the phase of the second roller 123 at Pos11 can be adjusted to θT.

In the case where 360°−R2>θdmax, the second roller 123 is reversely rotated by (360°−R2) per delay angle θd a plurality of times (n times) until the tip end of the sheet is held at the nip defined between the second roller 123 and the pinch roller 124.

For example, in the case where θd≤θdmax and 360°−R2=n×θd, the second roller 123 is reversely rotated by the delay angle θd n times. When the second roller 123 is further reversely rotated after the reverse rotation, the sheet is conveyed to accumulate the delay angle, followed by next reverse rotation such that the second roller 123 can be further reversely rotated within the delay angle.

$$\theta 10-n\times\theta d+\alpha 10=\theta 10-(360°-R2)+\alpha 1°=\theta T-360°$$

Hence, the phase of the second roller 123 has been adjusted to θT. Incidentally, in the case where 360°−R2≤θdmax, n is equal to 1.

The above-described embodiment can be applied to any sheet feeding device as long as a print-medium shaped printing medium or a printing medium such as a manuscript is fed one by one from the loading portion in an image forming apparatus such as a printer, a facsimile machine, a copying machine and the like regardless of its form or operating method. Moreover, when the image forming portion 17 is composed of a printing portion, various printing methods can be employed for the printing portion as long as an image is printed on a print medium by printing device on the basis of image information.

For example, other than an inkjet printing apparatus which performs printing by ejecting ink to a print medium from a ejection port of a printing head, any method of printing devices such as a laser beam type, a thermal transfer type, a thermal type, a wire-dot type and the like can be employed. For the printing portion, either of a serial type in which printing is performed by using a printing head mounted on a reciprocally moving carriage or a line type in which printing is performed only by vertical scanning (conveying) of a print medium by using a printing head extending in the width direction of the print medium may be used. Further, the present invention can be applied not only to an image forming apparatus having a printing portion but also similarly to other image forming apparatuses having a configuration in which a single or a plurality of devices are integrated.

As described above, the LF roller phase is obtained, phase matching is controlled so that the print medium comes to a desired position when the LF roller is at a desired phase, and skewing of the print medium is corrected by the same control method as the control of phase matching. As a result, a conveying device and a conveying control method which can control the phase of a main conveying roller and a position of a print medium with an inexpensive configuration and a fast throughput can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-179779, filed Aug. 19, 2011, which is hereby incorporated by reference herein in its entirety.

What is claimed is:

1. A conveying device comprising:

a first conveying roller for conveying a print medium in a conveying direction;

a second conveying roller provided downstream of the first conveying roller in the conveying direction and for conveying the print medium in the conveying direction;

a single driving source for driving the first conveying roller and the second conveying roller such that (i) in a case where the second conveying roller performs normal rotation, the first conveying roller performs normal rotation, (ii) until the second conveying roller performs reverse rotation at predetermined reverse rotation amount after rotation of the second conveying roller switches from normal rotation to reverse rotation, the first conveying roller does not perform rotation, and then after the second conveying roller performs reverse rotation at the predetermined reverse rotation amount, the first conveying roller performs normal rotation;

an obtaining unit configured to obtain a reverse rotation amount which is needed for a phase of the second conveying roller is to be a desired phase of the second conveying roller, the phase of the second conveying roller being a phase at a timing which the second conveying roller starts conveying the print medium downstream in the conveying direction;

a correcting unit configured to correct skewing of the print medium by bending the print medium between the first conveying roller and the second conveying roller in a conveying path of the print medium; and a controlling unit configured to control driving of the second conveying roller by the single driving source on the basis of the reverse rotation amount obtained by the obtaining unit so as to (i) in a case where the reverse rotation amount obtained by the obtaining unit is smaller than the predetermined reverse rotation amount, perform reverse rotation of the second conveying roller at one time in association with correcting skewing of the print medium by the correcting unit, and (ii) in a case where the reverse rotation amount obtained by the obtaining unit is larger than the predetermined reverse rotation amount, perform reverse rotation of the second conveying roller at plural times in association with correcting skewing of the print medium by the correcting unit.

2. The conveying device according to claim 1, wherein said obtaining unit is a first obtaining unit, and further comprising;

a detecting unit configured to detect a position of the print medium in the conveying direction;

a second obtaining unit configured to obtain a phase of the second conveying roller at a timing which the detecting unit detects leading end position of the print medium in the conveying direction; and a third obtaining unit configured to obtain a desired phase of the second conveying roller at the timing which the second conveying roller starts conveying the print medium to downstream than the second conveying roller in the conveying direction, wherein the first obtaining unit obtains the reverse rotation amount on a basis of the phase of the second conveying roller obtained by the second obtaining unit and the desired phase of the second conveying roller obtained by the third obtaining unit.

3. The conveying device according to claim 1, wherein the controlling unit controls driving of the second conveying roller by the single driving source, in association with correcting skewing of the print medium by the correcting unit, so as to perform (i) a first driving which performs normal rotation of the second conveying roller till leading end position of the print medium in the conveying direction is positioned at downstream than the second conveying roller in the conveying direction, and (ii) a second driving which performs reverse rotation of the second conveying roller after the first driving is performed.

4. The conveying device according to claim 3, wherein the controlling unit controls driving of the second conveying roller by the single driving source so as to perform reverse rotation at the reverse rotation amount obtained by the obtaining unit in the second driving, in a case where the reverse rotation amount obtained by the obtaining unit is smaller than the predetermined reverse rotation amount.

5. The conveying device according to claim 3, wherein the controlling unit controls driving of the second conveying roller by the single driving source so as to perform (i) reverse rotation at a difference of the reverse rotation amount obtained by the obtaining unit and the predetermined reverse rotation amount in the first driving, and (ii) reverse rotation at the predetermined rotation amount in the second driving, in a case where the reverse rotation amount obtained by the obtaining unit is larger than the predetermined reverse rotation amount.

6. The conveying device according to claim 1, further comprising a printing head for printing an image.

7. The conveying device according to claim 6, further comprising a scanning unit configured to cause the printing head to scan the print medium.

* * * * *